US011854523B2

(12) United States Patent
Gomi et al.

(10) Patent No.: US 11,854,523 B2
(45) Date of Patent: Dec. 26, 2023

(54) SOUND ABSORBER, SOUND ABSORBING PANEL AND SOUND ABSORBING WALL

(71) Applicant: Pixie Dust Technologies, Inc., Tokyo (JP)

(72) Inventors: Masaki Gomi, Tokyo (JP); Yudai Taira, Tokyo (JP)

(73) Assignee: Pixie Dust Technologies, Inc., Tokyo (JP)

( * ) Notice: Subject to any disclaimer, the term of this patent is extended or adjusted under 35 U.S.C. 154(b) by 0 days.

(21) Appl. No.: 18/296,656

(22) Filed: Apr. 6, 2023

(65) Prior Publication Data

US 2023/0260496 A1 Aug. 17, 2023

Related U.S. Application Data

(63) Continuation of application No. PCT/JP2022/026161, filed on Jun. 30, 2022.

(30) Foreign Application Priority Data

Aug. 6, 2021 (JP) ..... 2021-129497
Dec. 2, 2021 (JP) ..... 2021-196557
Mar. 9, 2022 (JP) ..... 2022-036141

(51) Int. Cl.
*G10K 11/172* (2006.01)

(52) U.S. Cl.
CPC ..... *G10K 11/172* (2013.01)

(58) Field of Classification Search
CPC ..... G10K 11/172
See application file for complete search history.

(56) References Cited

U.S. PATENT DOCUMENTS

2019/0122649 A1* 4/2019 Sheng ..... G10K 11/168
2019/0213990 A1* 7/2019 Jonza ..... B32B 3/12
(Continued)

FOREIGN PATENT DOCUMENTS

CN 112712784 A * 4/2021
JP H0962267 A 3/1997
(Continued)

OTHER PUBLICATIONS

International Search Report dated Sep. 6, 2022, in corresponding International Patent Application No. PCT/JP2022/026161, 5 pages.
(Continued)

*Primary Examiner* — Forrest M Phillips
(74) *Attorney, Agent, or Firm* — Maier & Maier, PLLC

(57) ABSTRACT

A sound absorber includes cavities mutually different in at least one of shape and size. A wall of a first cavity included in the cavities includes a first region and a second region. Through-holes connecting an interior to an exterior of the first cavity is formed in the first region. No through-holes connecting the interior and the exterior of the first cavity is formed in the second region adjacent to the first region. A wall of a second cavity included in the cavities includes a third region and a fourth region. Through-holes connecting an interior to an exterior of the second cavity is formed in the third region. No through-holes connecting the interior and the exterior of the second cavity is formed in the fourth region adjacent to the third region. Size of through-holes in the first region is different from size of through-holes in the third region.

18 Claims, 32 Drawing Sheets

(56) References Cited

U.S. PATENT DOCUMENTS

| | | | | |
|---|---|---|---|---|
| 2019/0264614 | A1* | 8/2019 | Versaevel | G10K 11/172 |
| 2021/0115664 | A1* | 4/2021 | McGee | C03B 23/0252 |

FOREIGN PATENT DOCUMENTS

| | | | |
|---|---|---|---|
| JP | 2009030432 | A | 2/2009 |
| JP | 2017115572 | A | 6/2017 |

OTHER PUBLICATIONS

Wu et al., "Low-frequency sound absorption of hybrid absorber based on micro-perforated panel and coiled-up channels" Applied Physics Letters 114, 151901 (Apr. 16, 2019); doi: 10.1063/1.5090355, 6 pages.

Notice of Reasons for Refusal dated Aug. 25, 2022, in corresponding Japanese Patent Application No. 2022-548389, 9 pages.

Decision to Grant a Patent dated Sep. 27, 2022, in corresponding Japanese Patent Application No. 2022-548389, 5 pages.

* cited by examiner

[FIG. 1A]
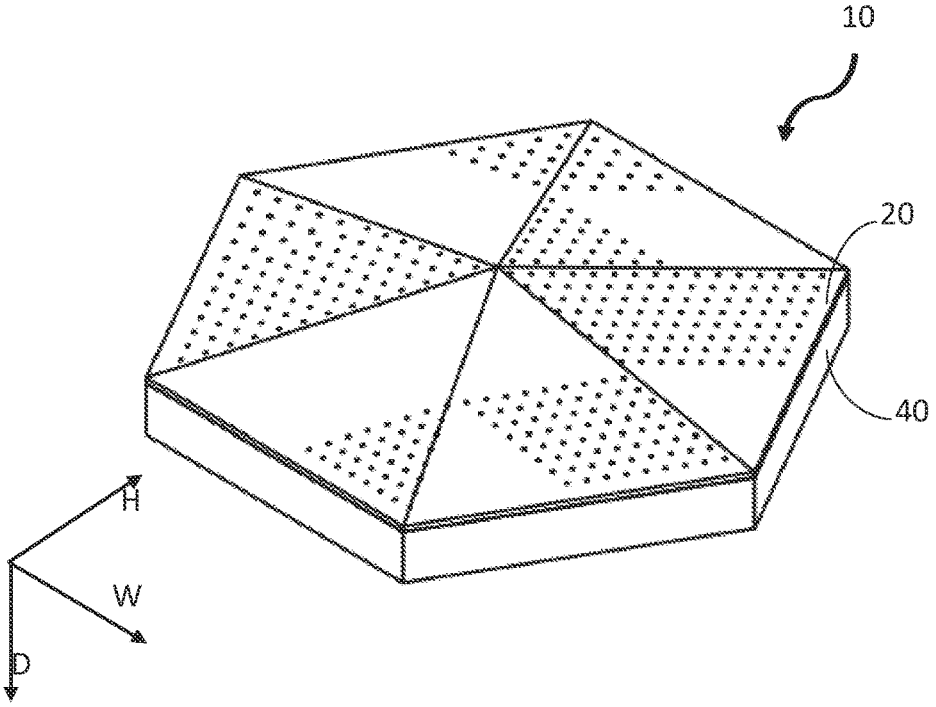
[FIG. 1B]
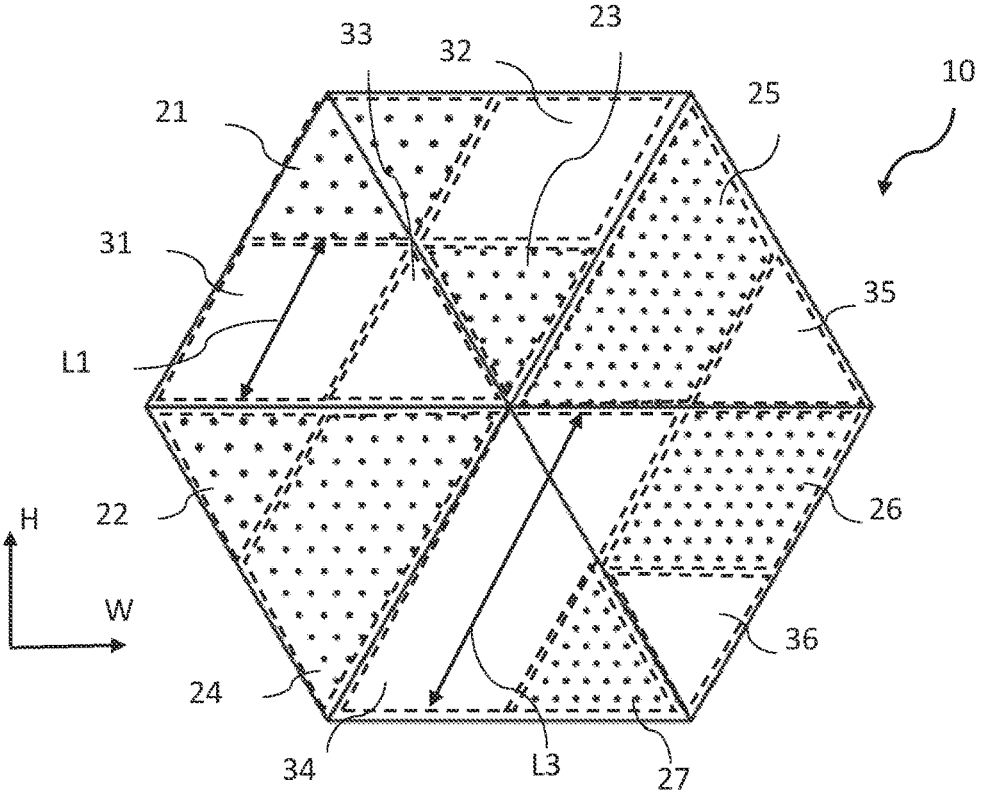

[FIG. 2A]
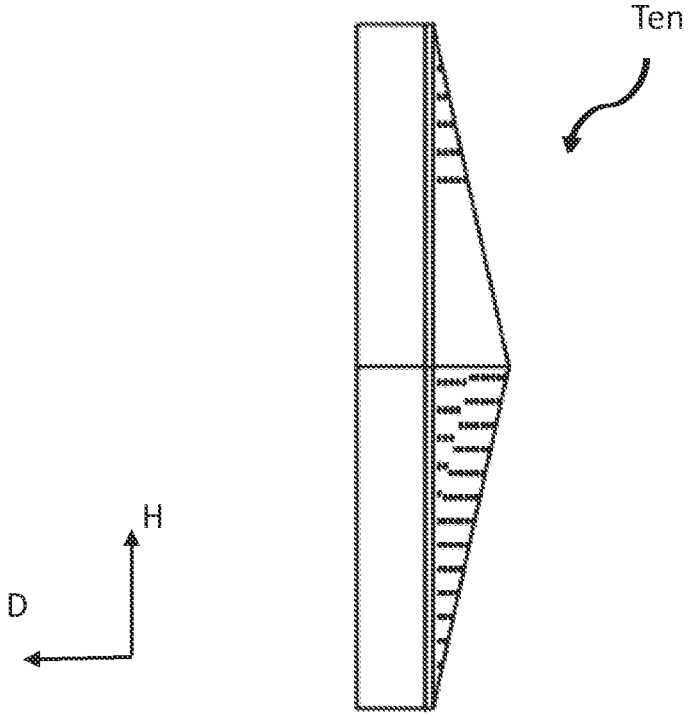
[FIG. 2B]
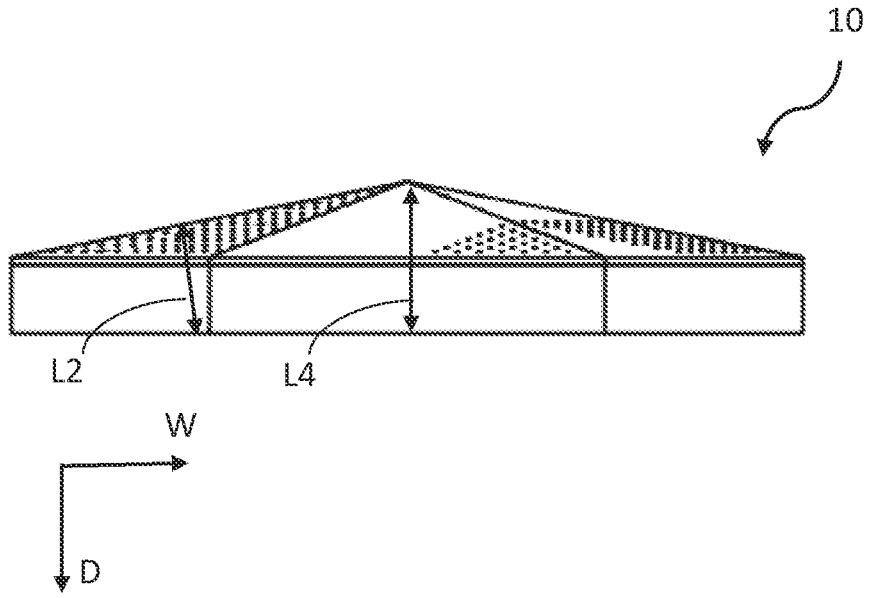

[FIG. 3A]
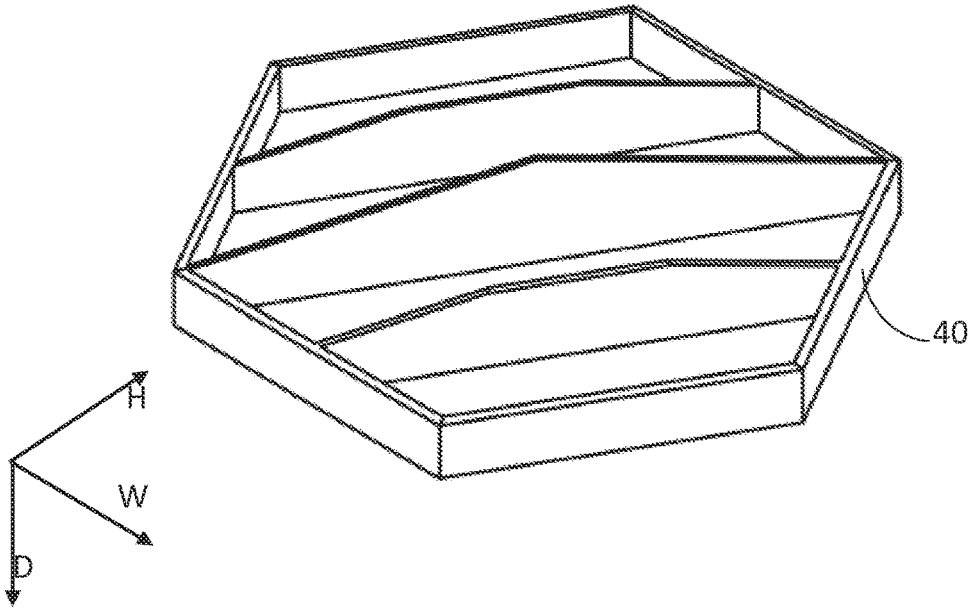
[FIG. 3B]
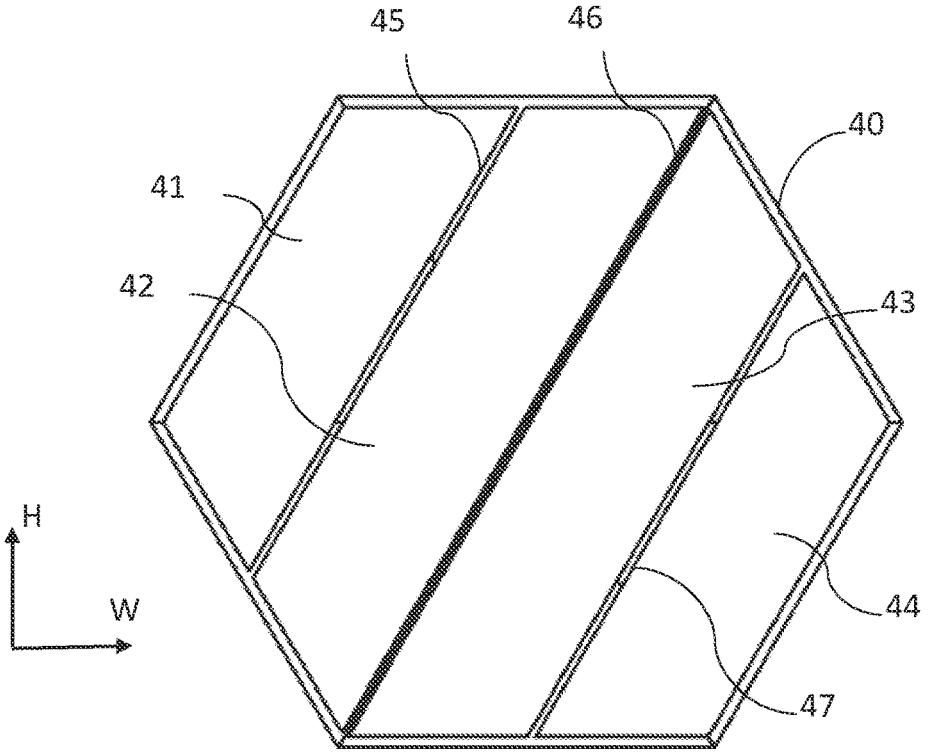

[FIG. 4A]
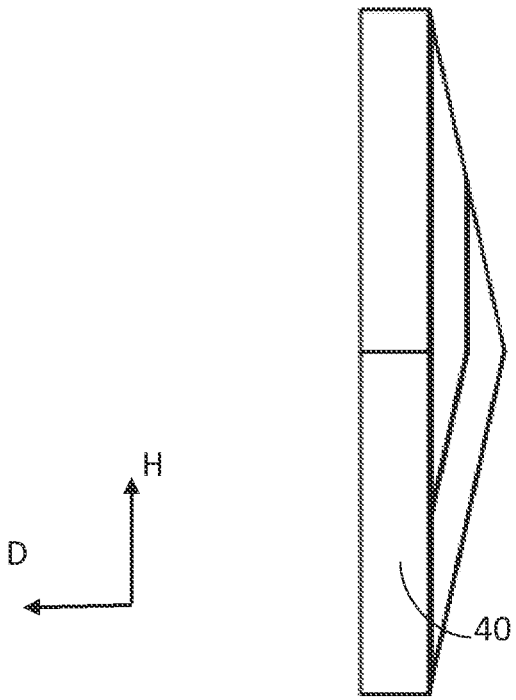
[FIG. 4B]
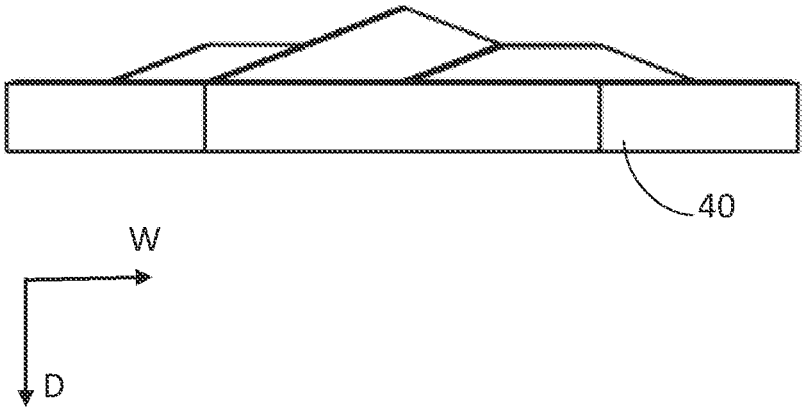

[Fig. 5]
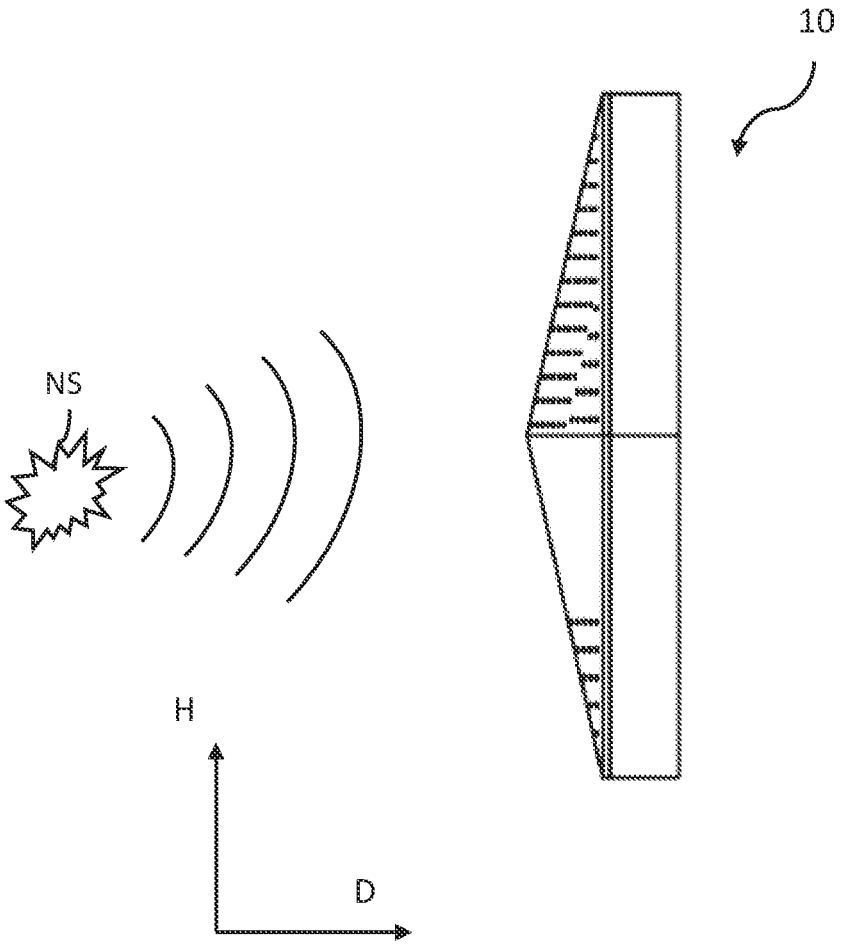

[Fig. 6]
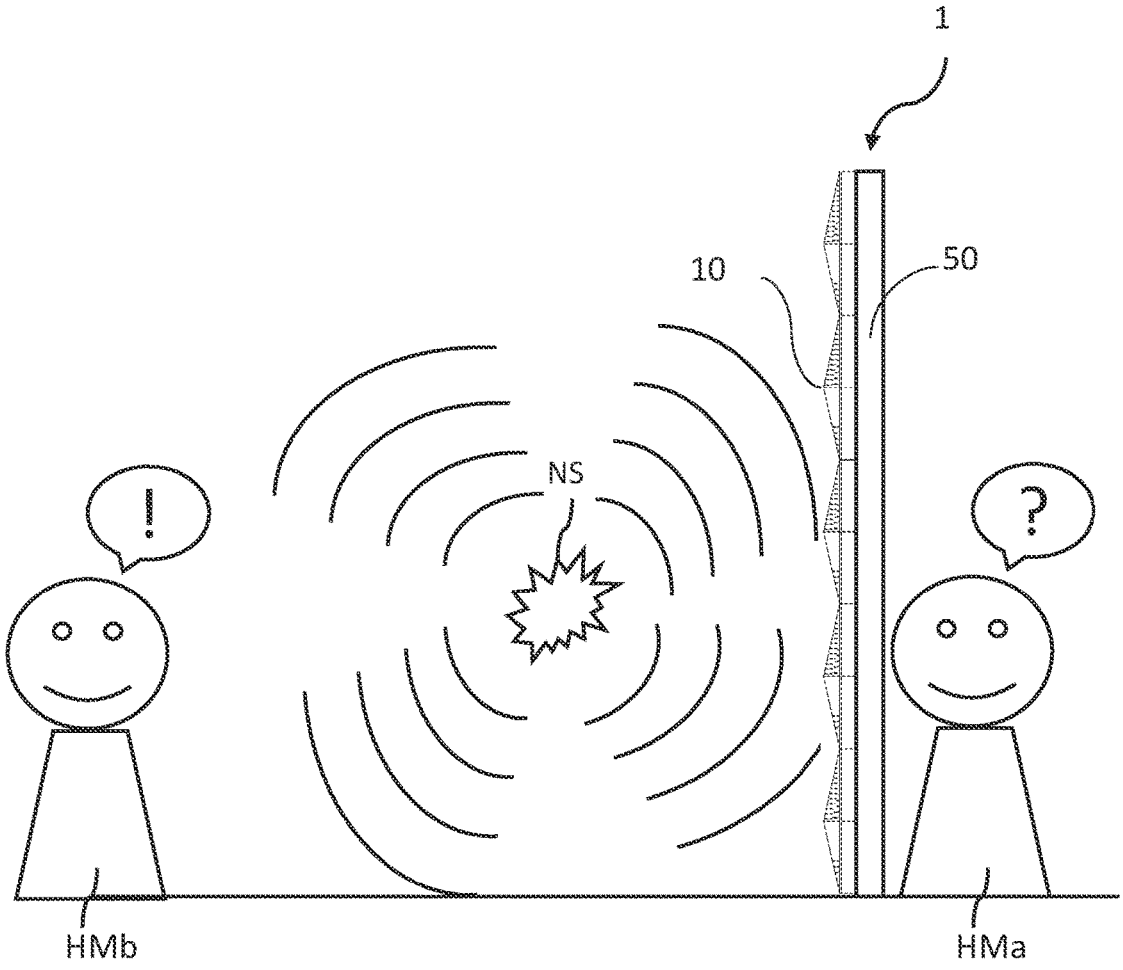

[Fig. 7]
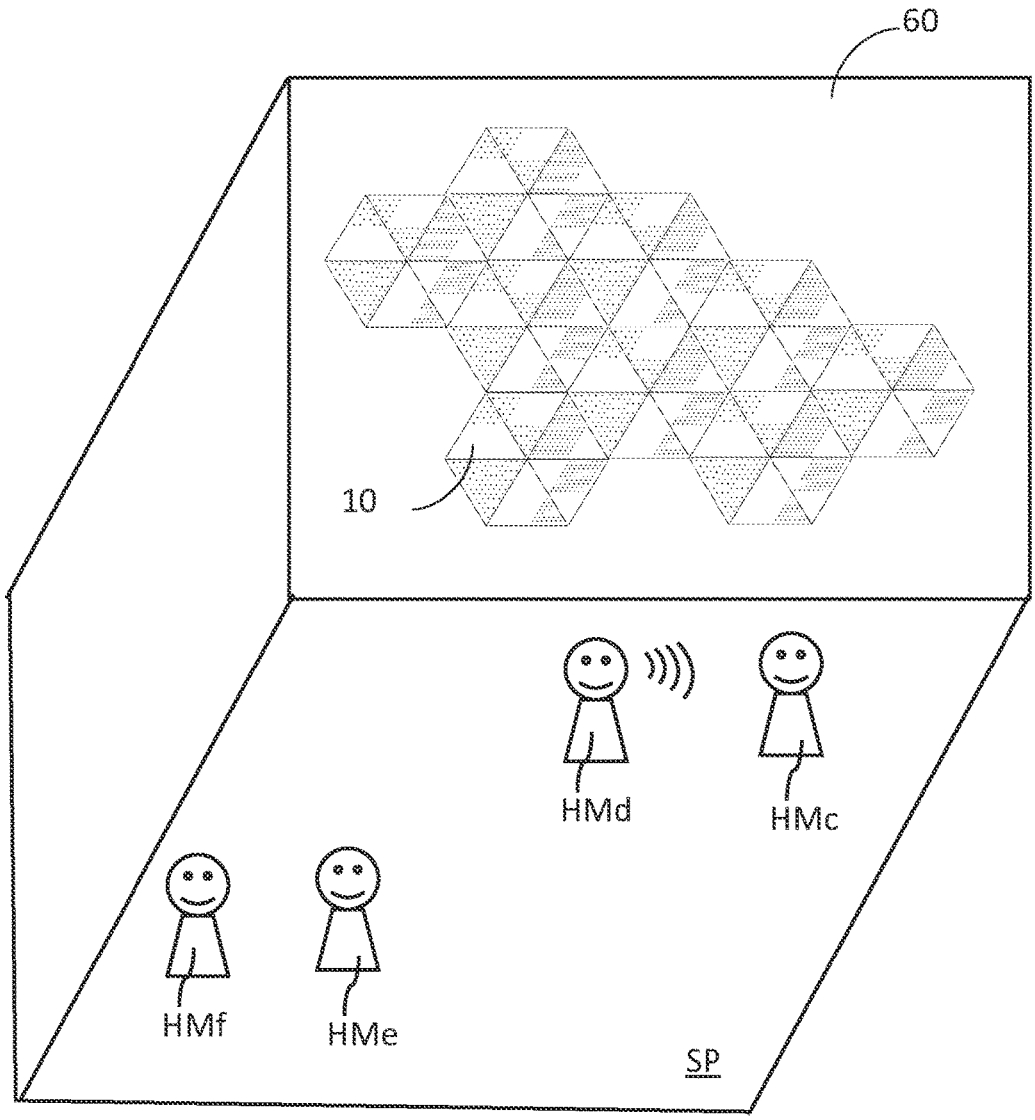

[Fig. 8]
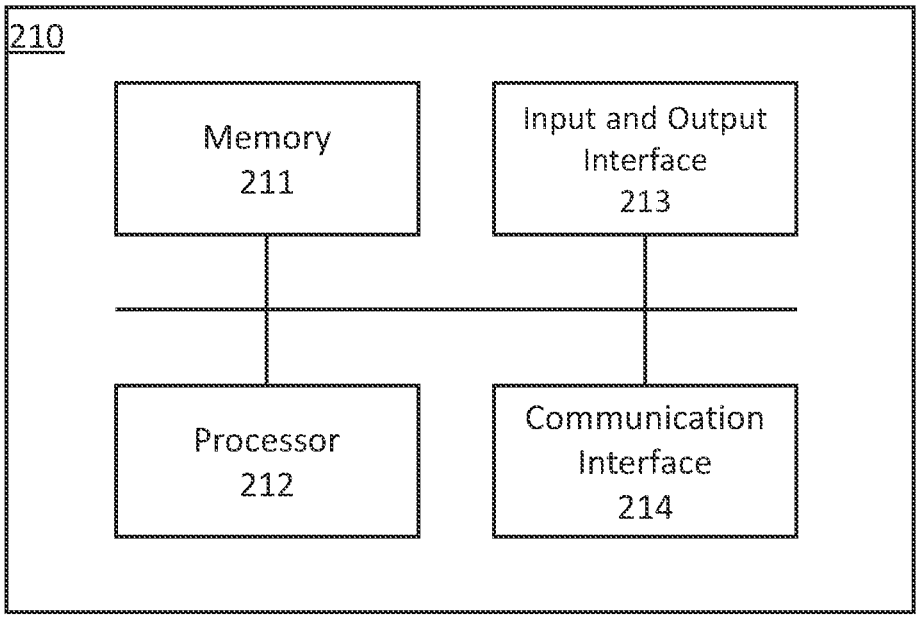

[Fig. 9]
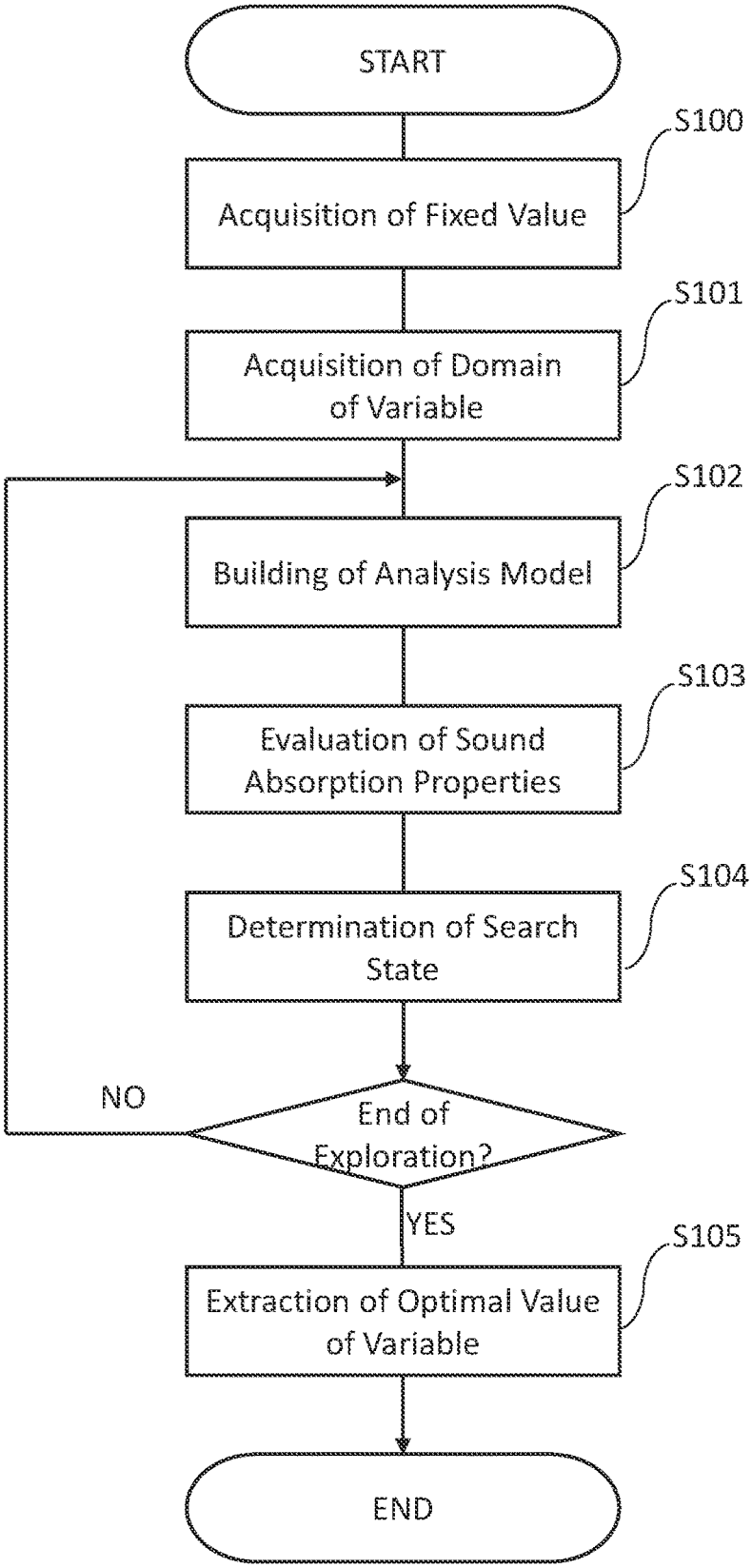

[Fig. 10A]
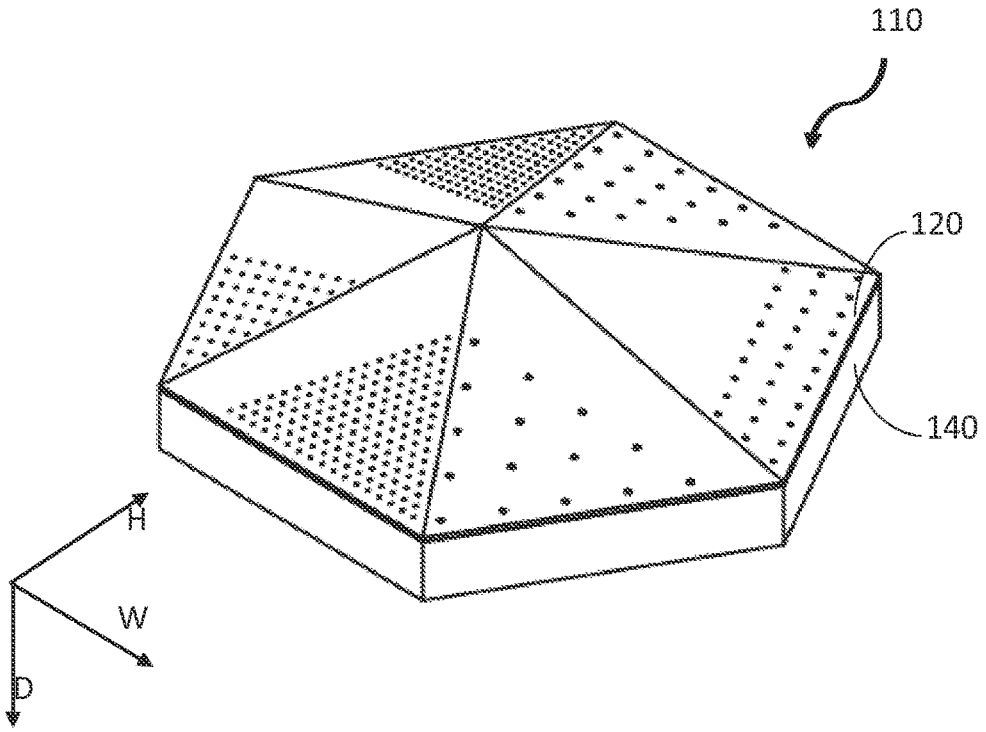
[Fig. 10B]
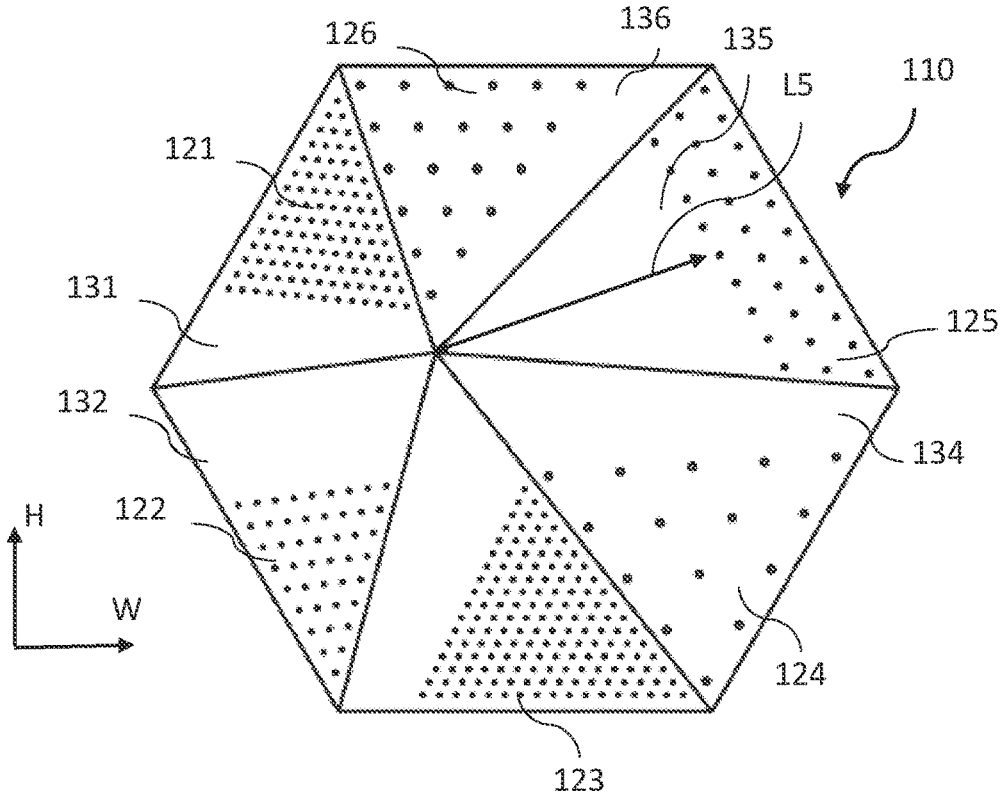

[Fig. 11A]
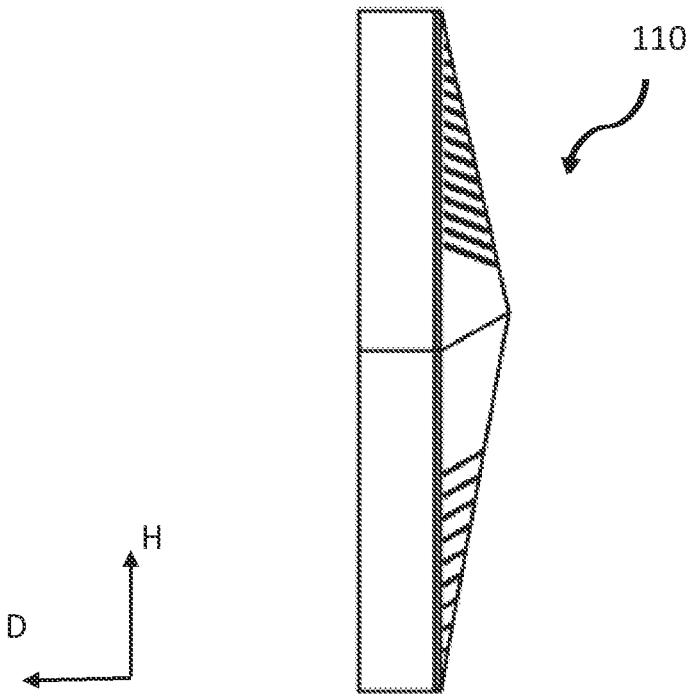
[Fig. 11B]
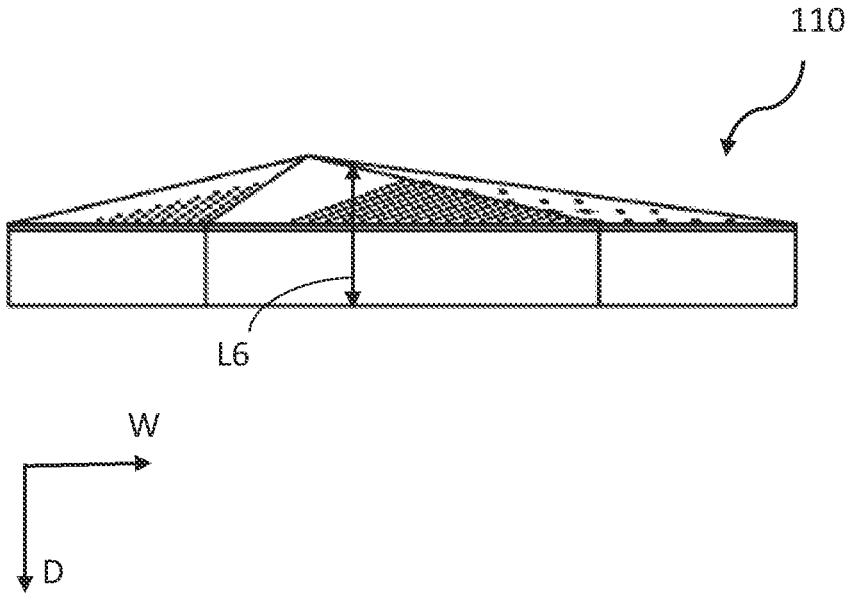

[Fig. 12A]
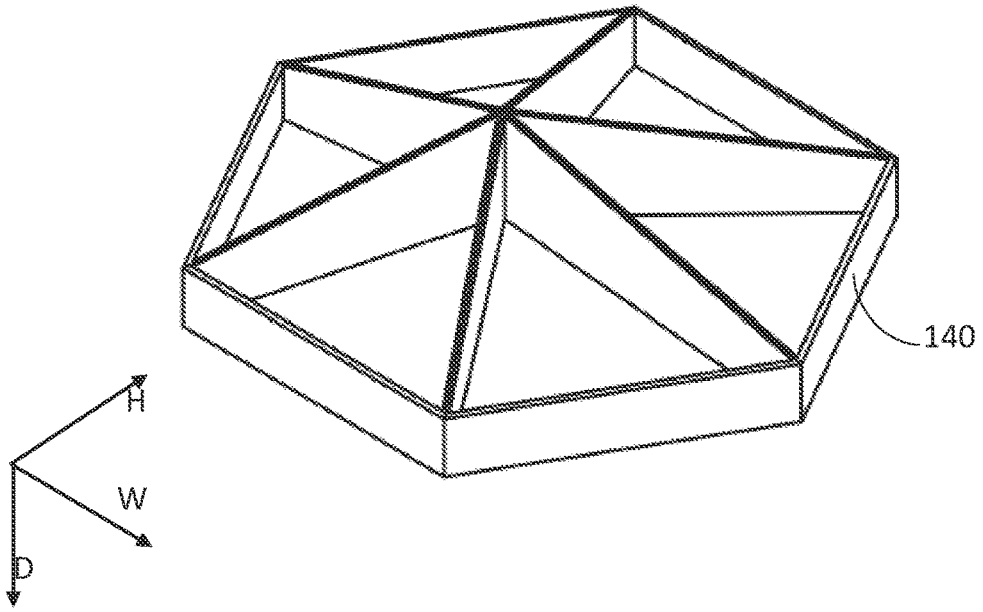
[Fig. 12B]
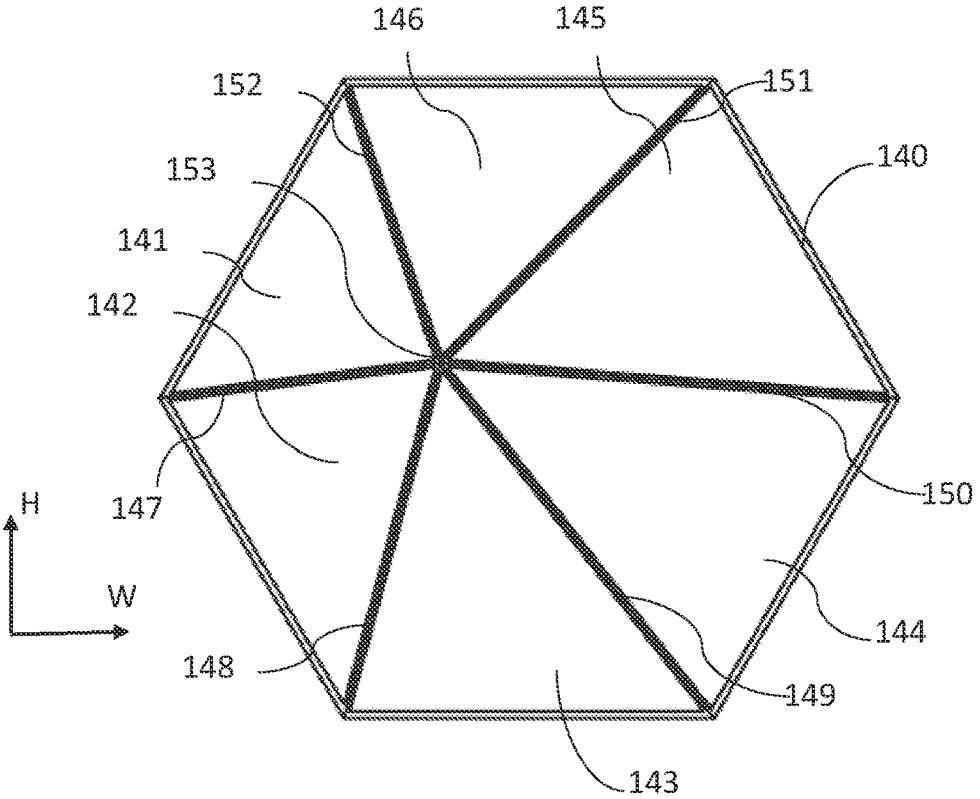

[Fig. 13A]
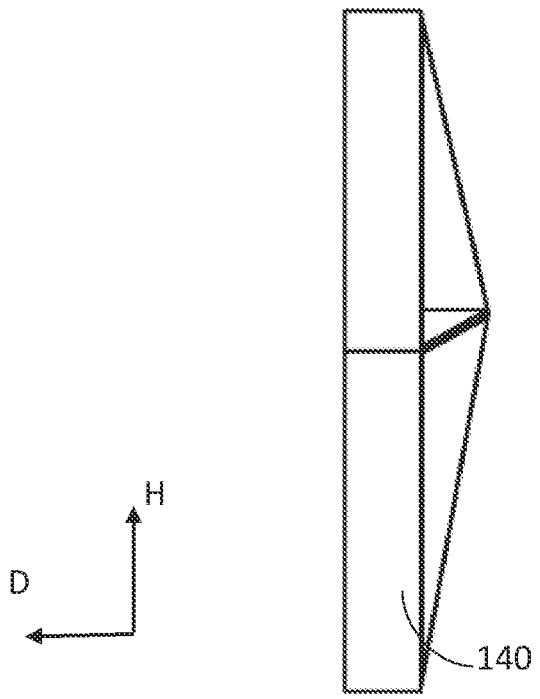
[Fig. 13B]
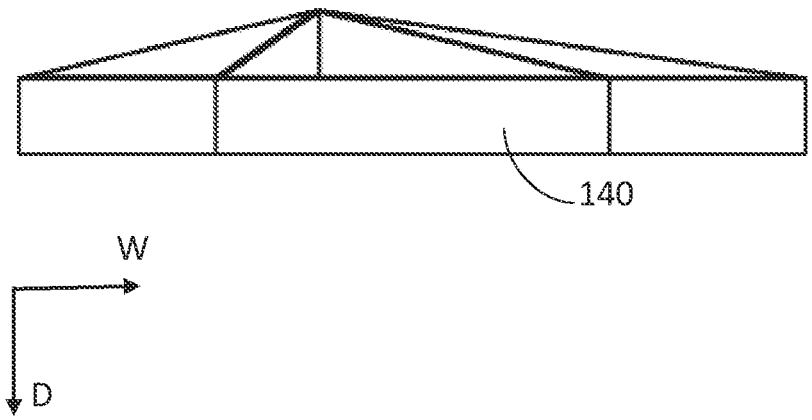

[Fig. 14]
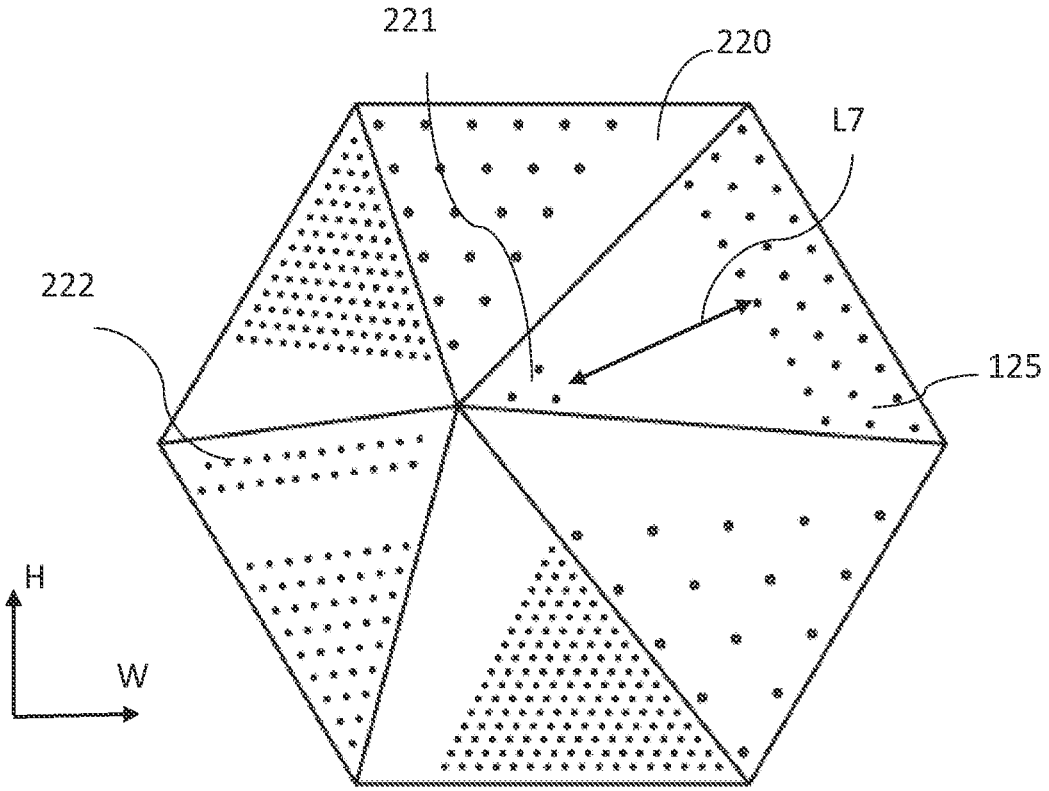

[Fig. 15A]
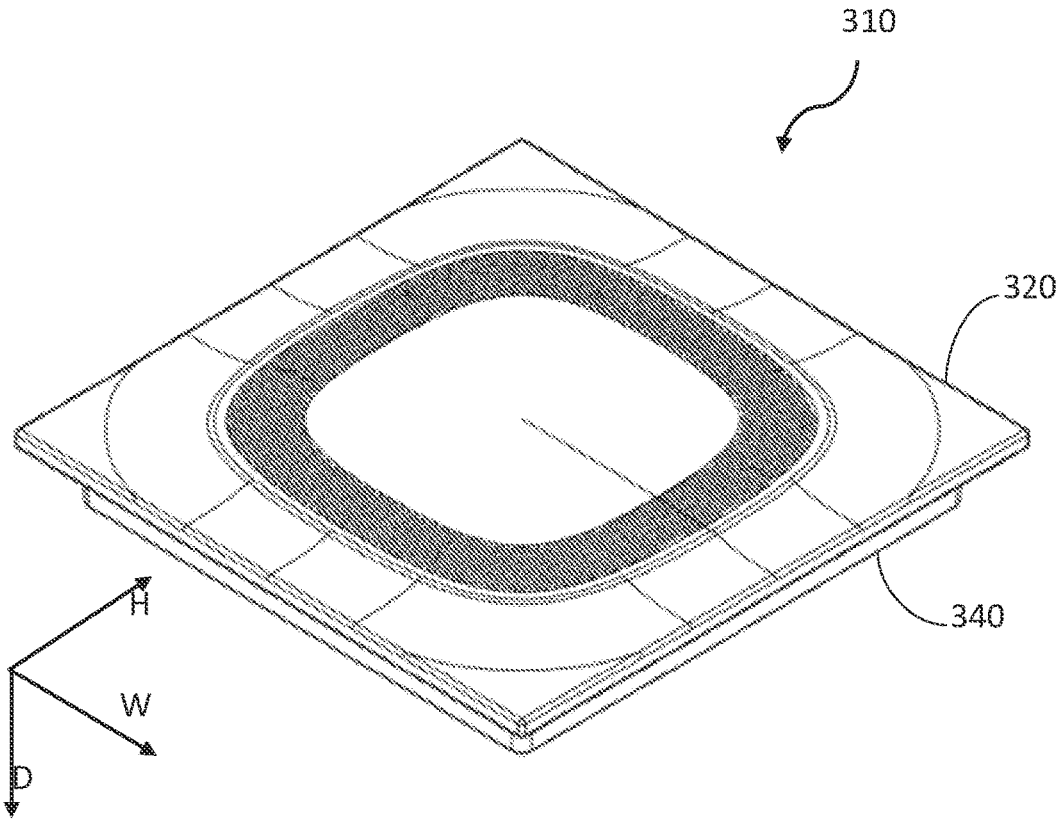
[Fig. 15B]
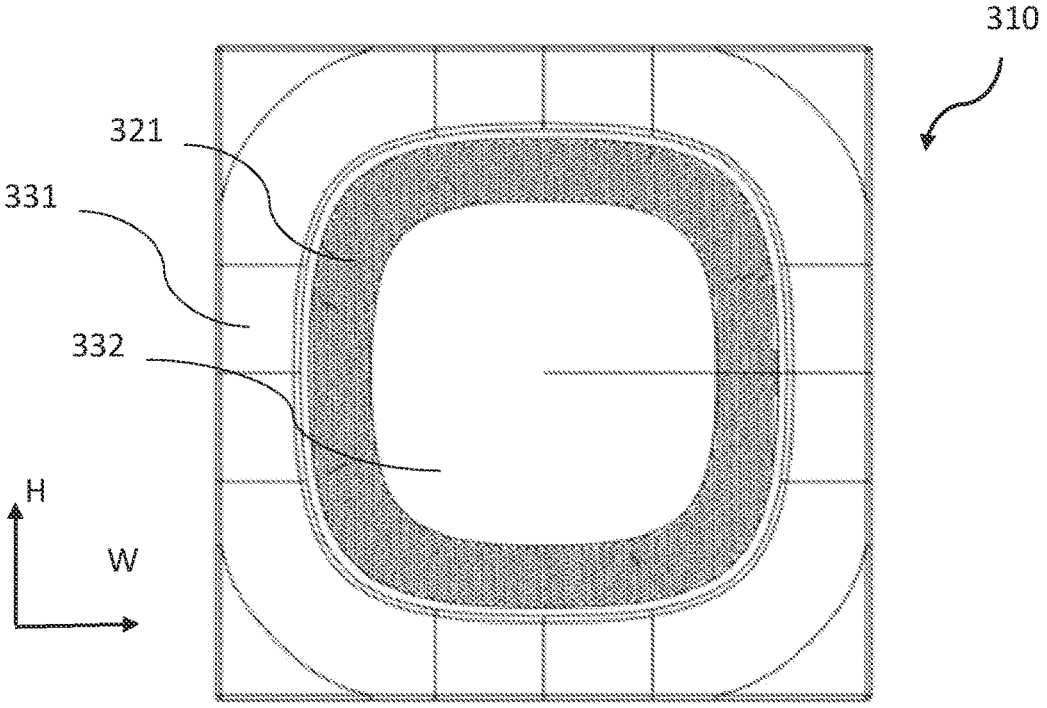

[Fig. 16A]
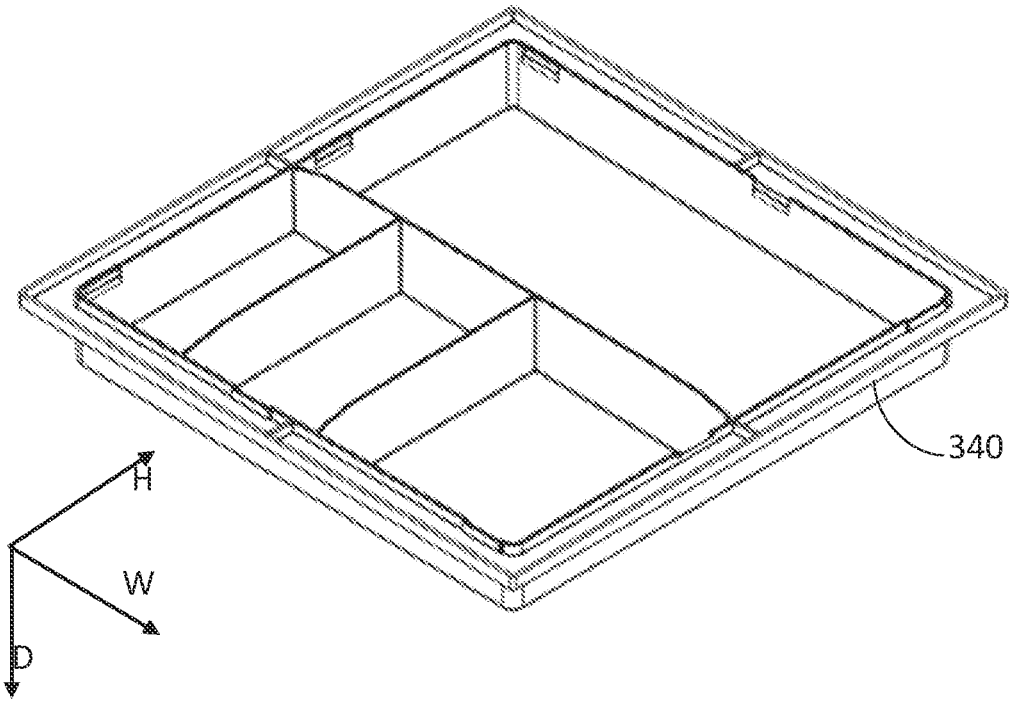
[Fig. 16B]
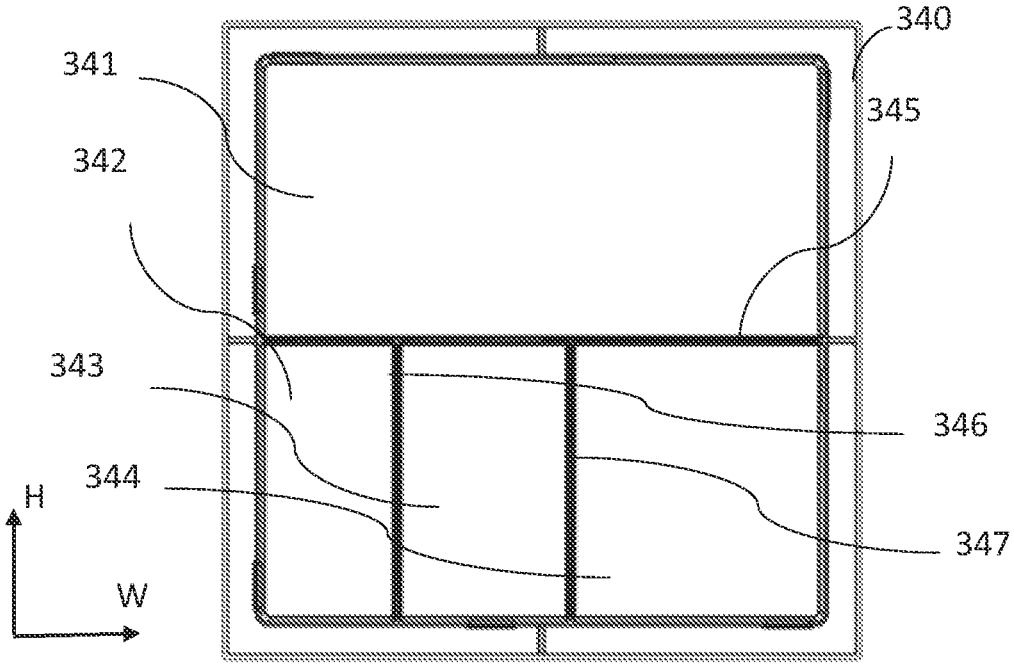

[Fig. 17A]
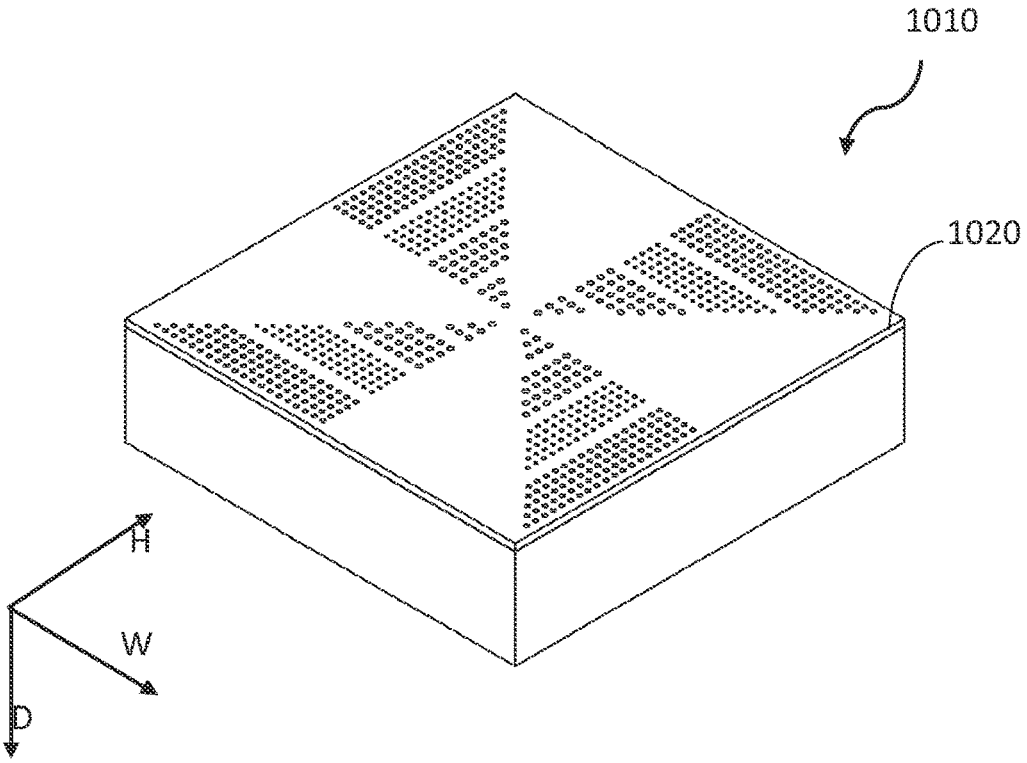
[Fig. 17B]
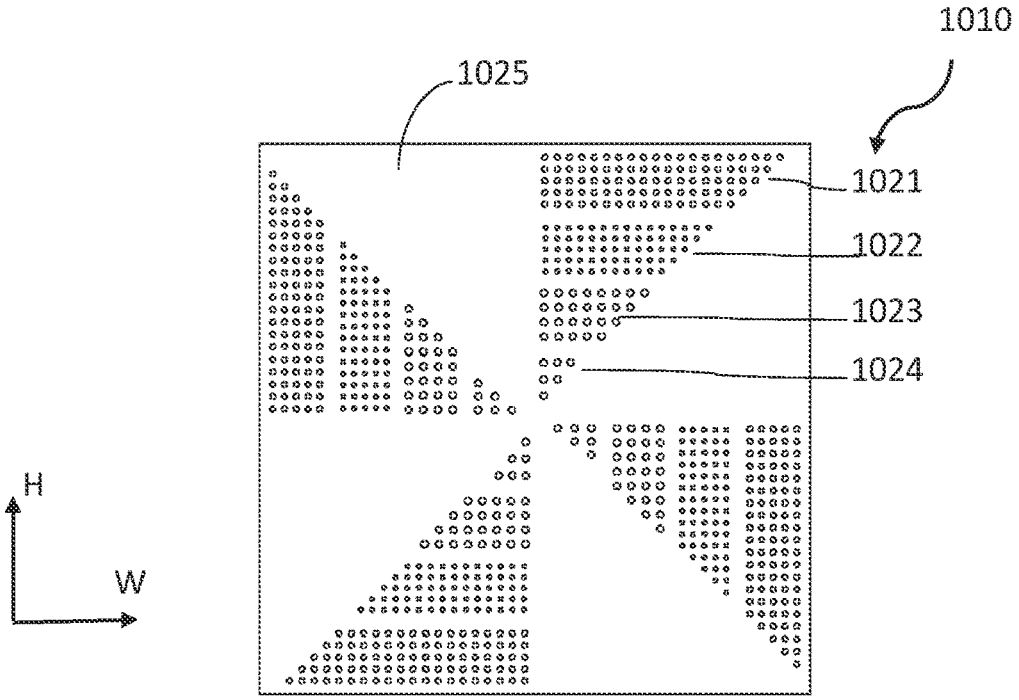

[Fig. 18A]
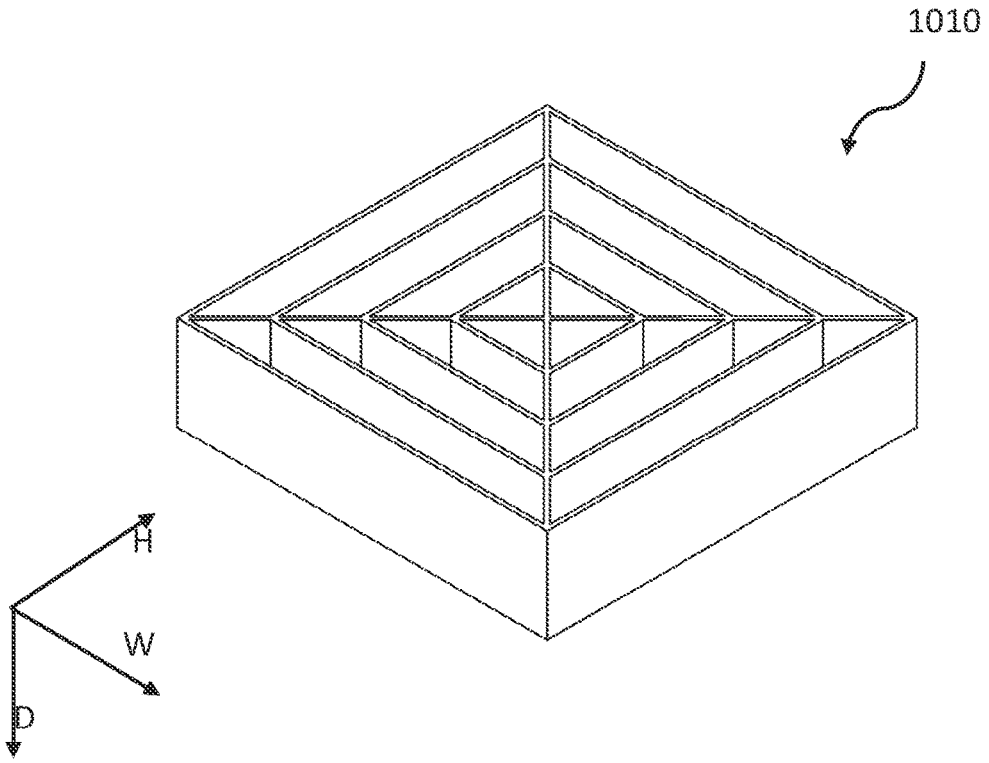
[Fig. 18B]
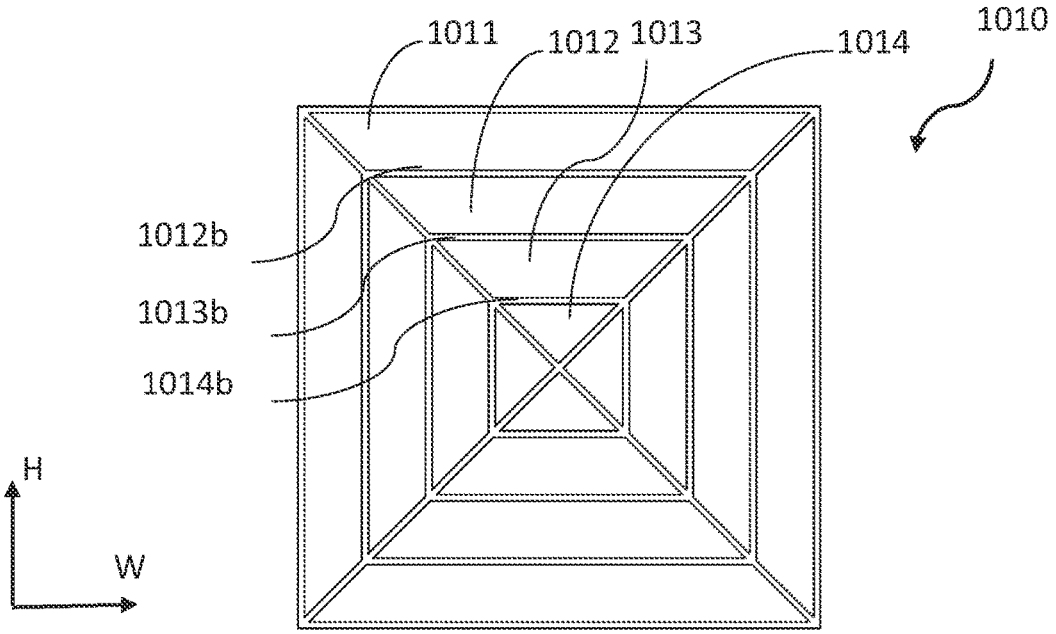

[Fig. 19A]
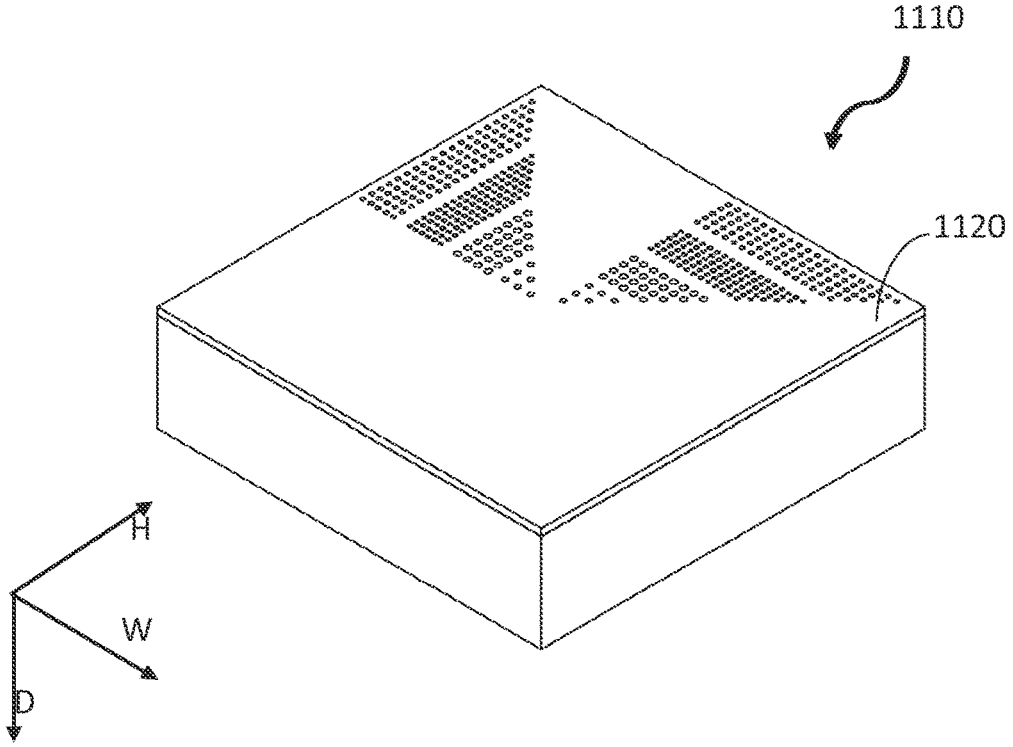
[Fig. 19B]
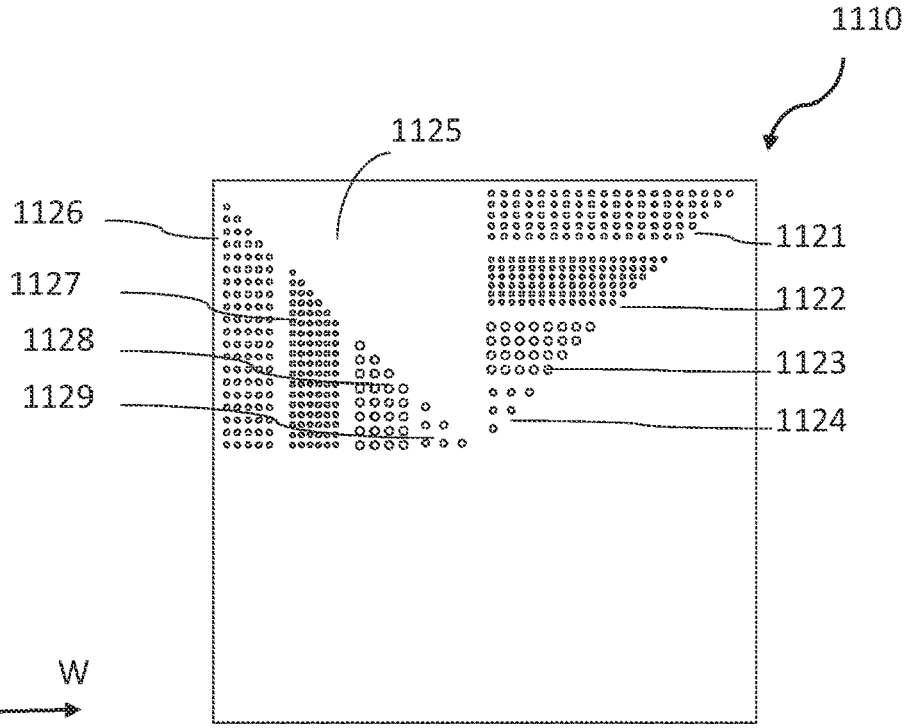

[Fig. 20A]
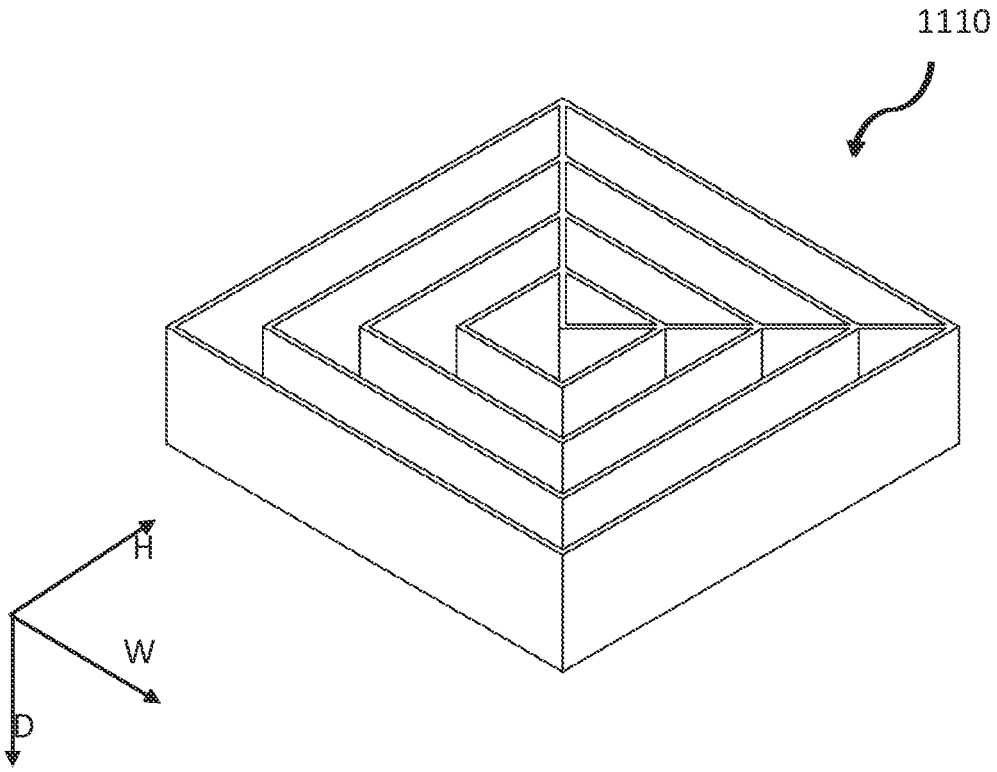
[Fig. 20B]
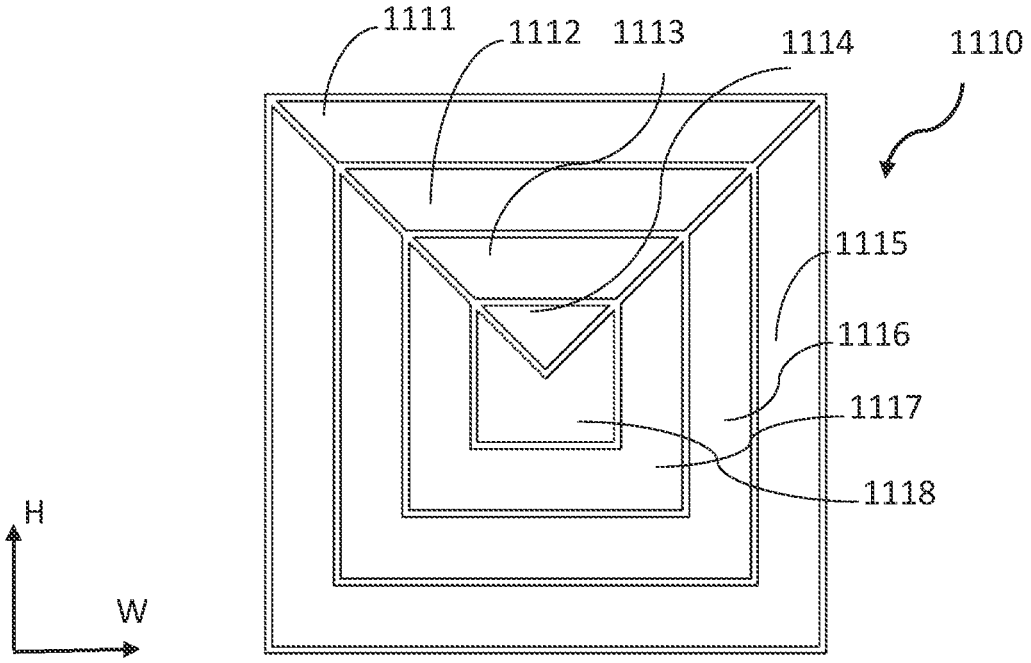

[Fig. 21A]
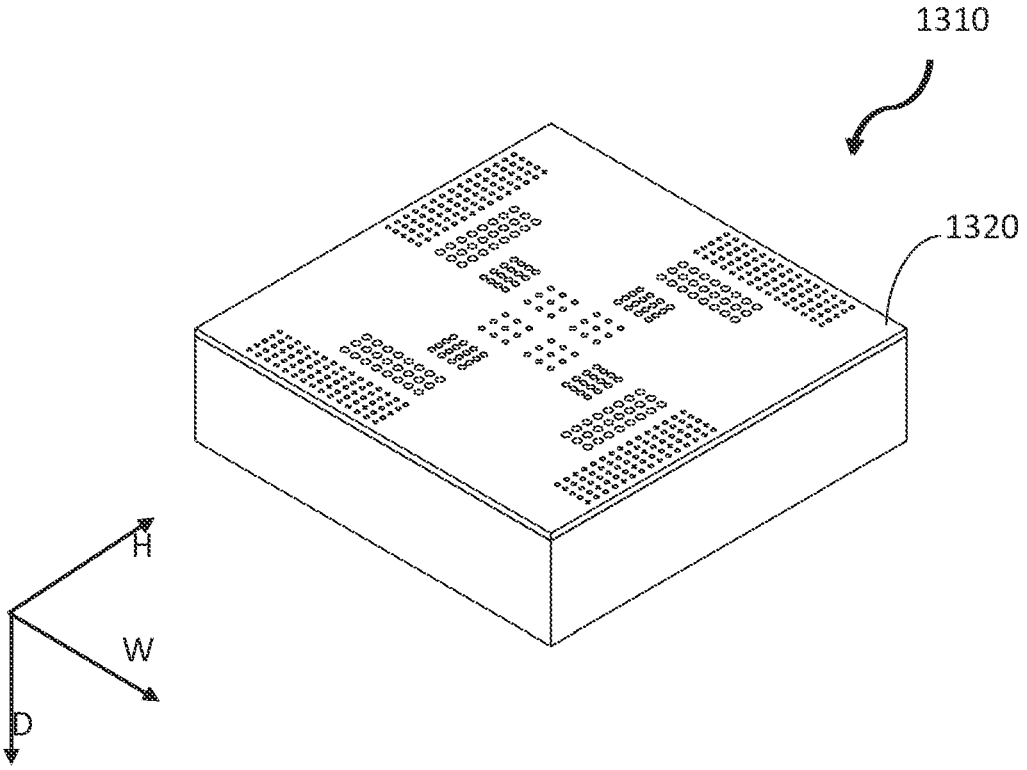
[Fig. 21B]
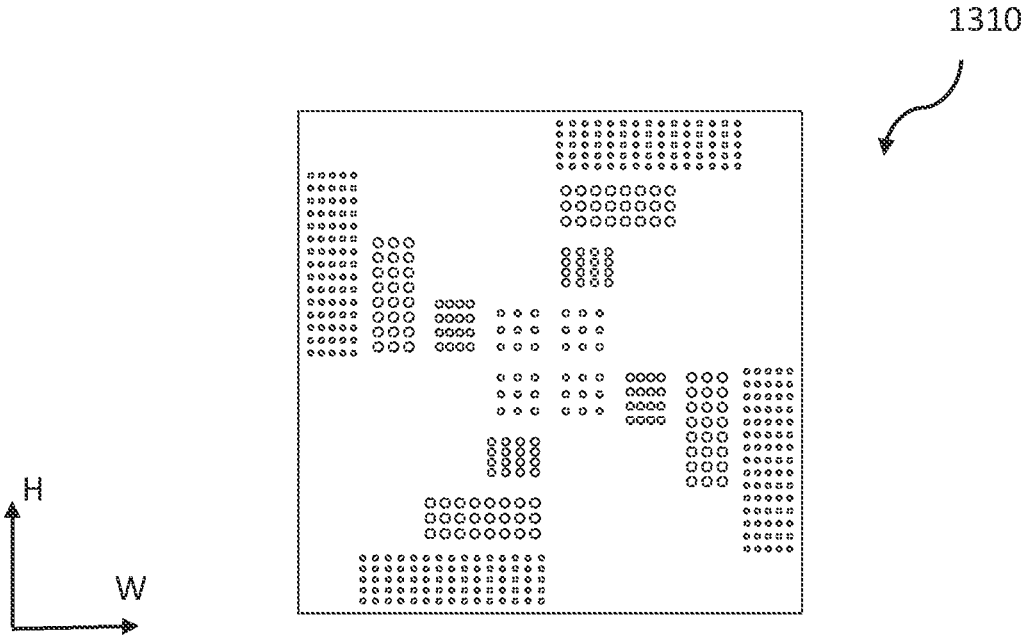

[Fig. 22A]
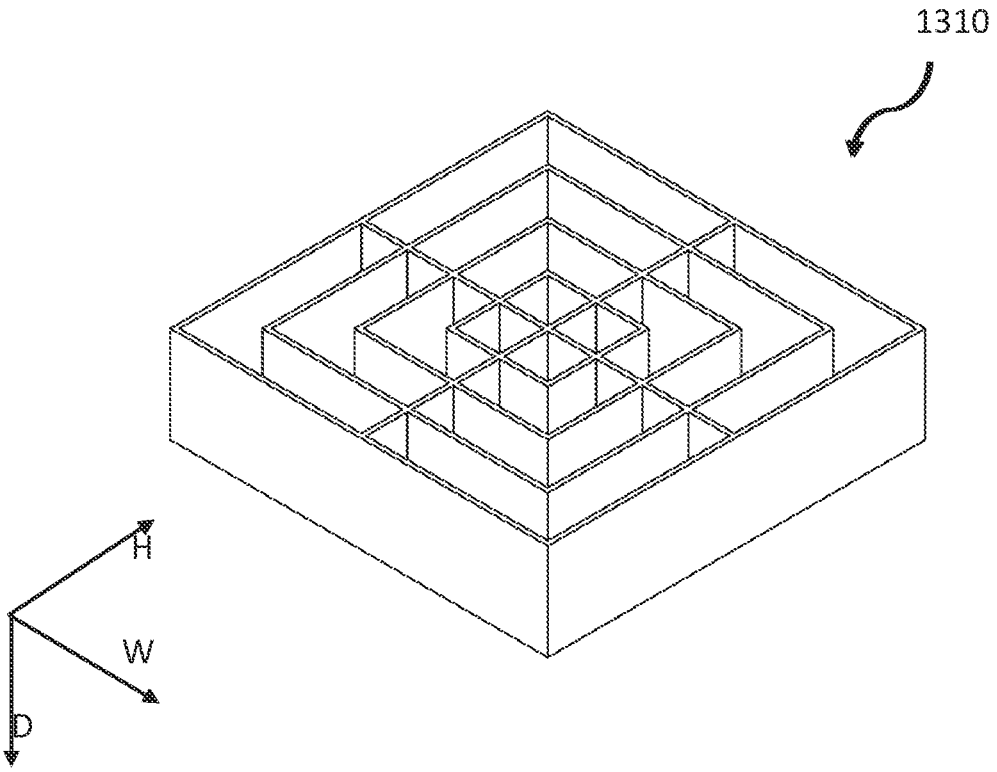
[Fig. 22B]
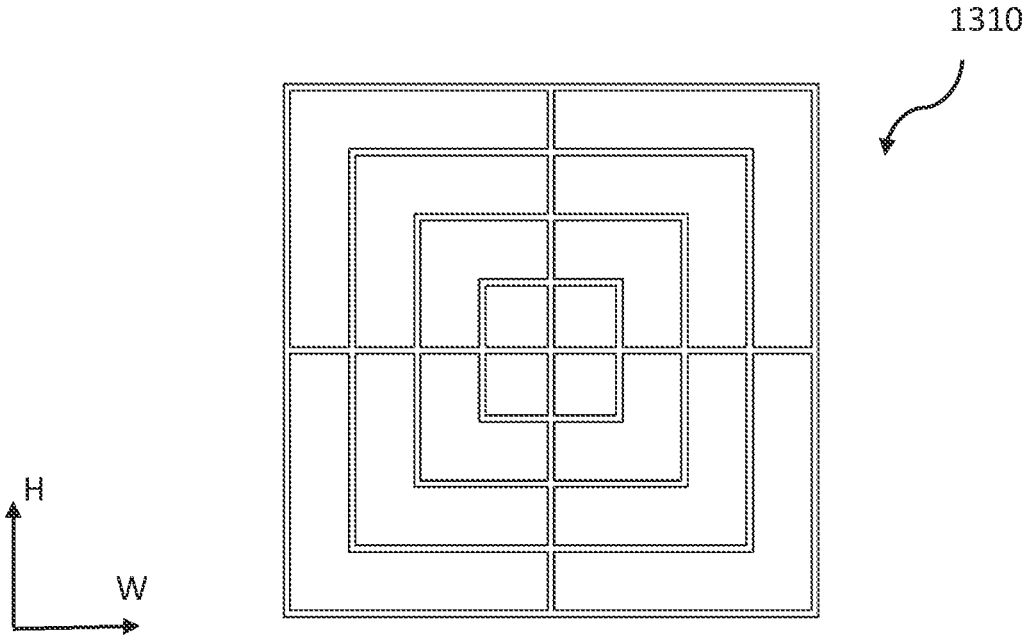

[Fig. 23A]
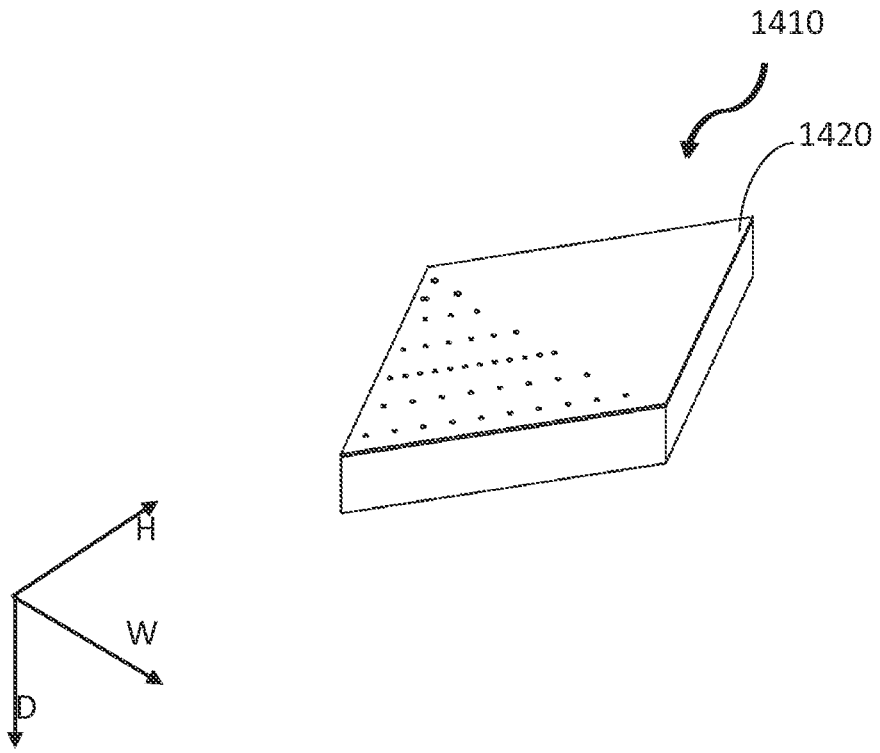
[Fig. 23B]
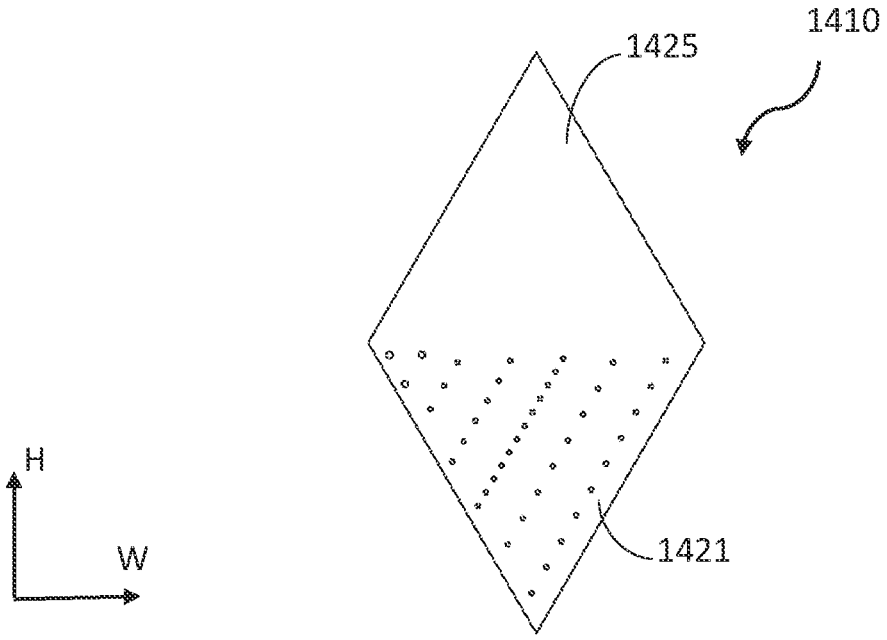

[Fig. 24A]
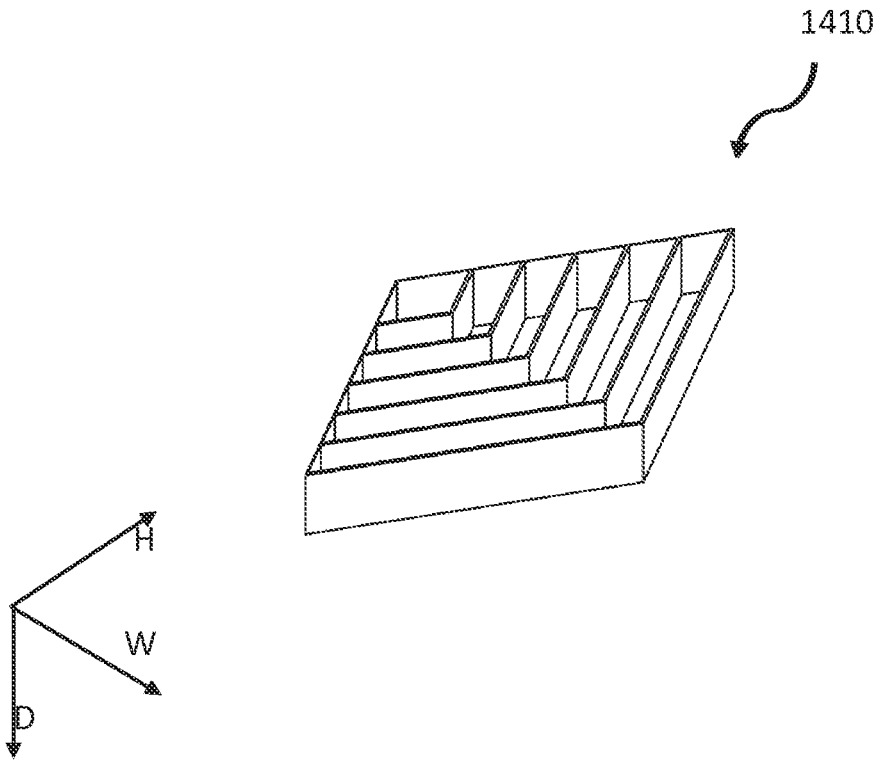
[Fig. 24B]
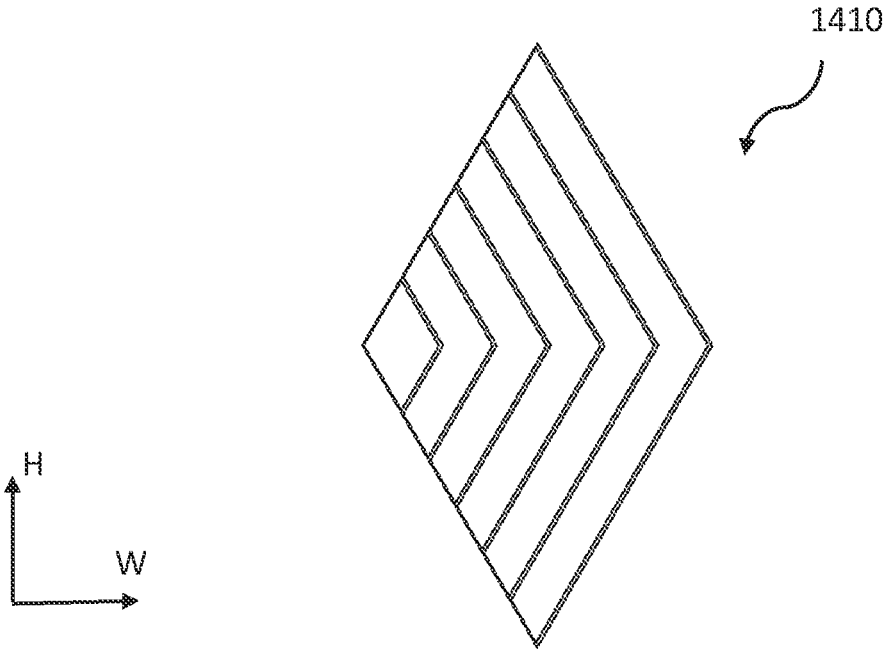

[Fig. 26A]
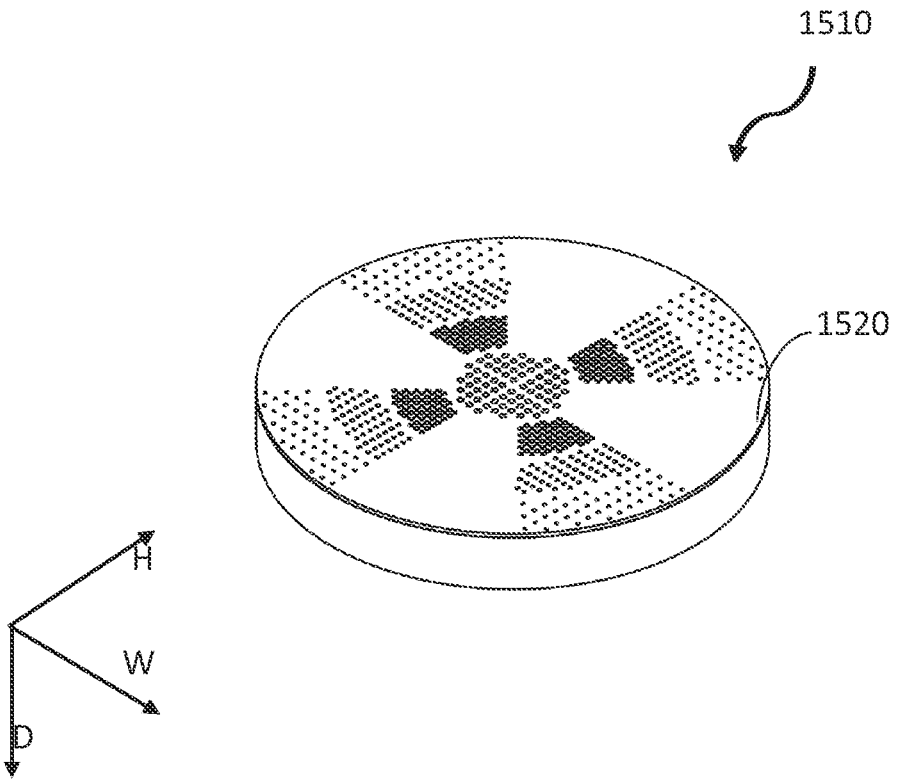
[Fig. 26B]
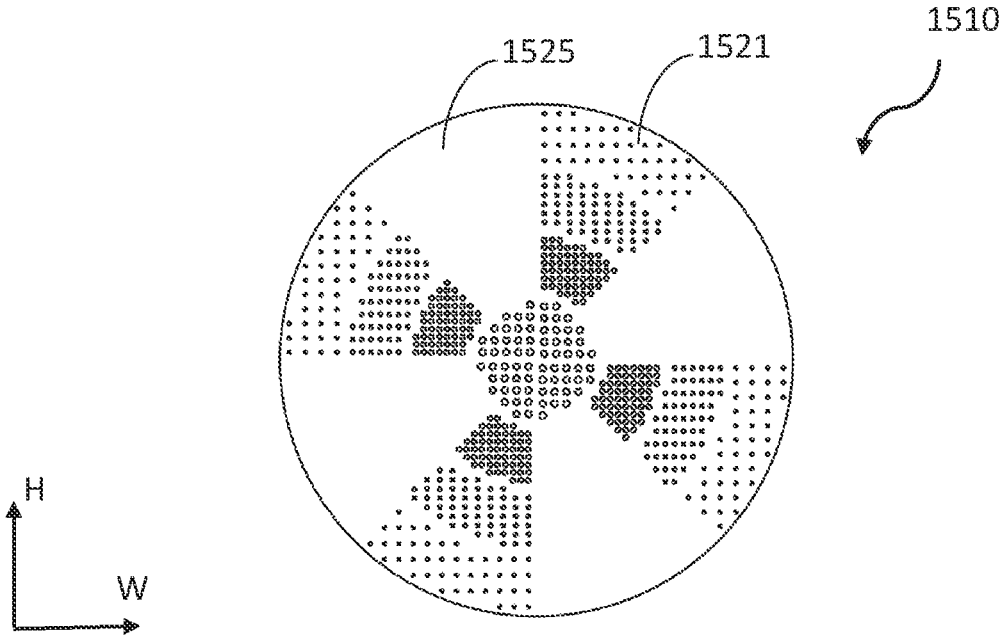

[Fig. 26A]
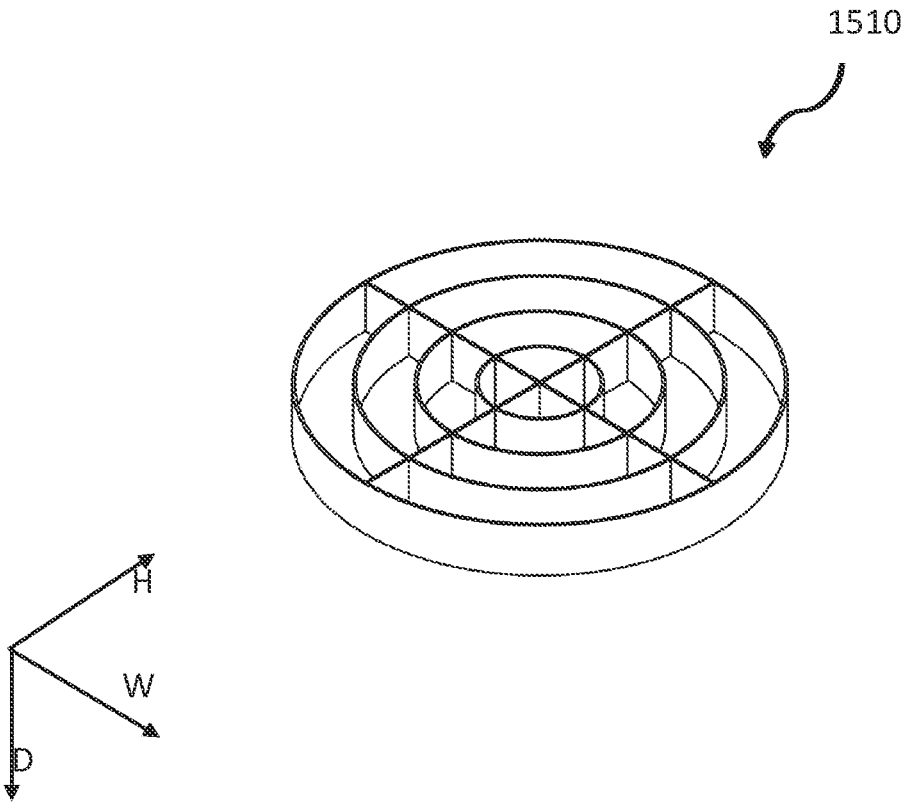
[Fig. 26B]
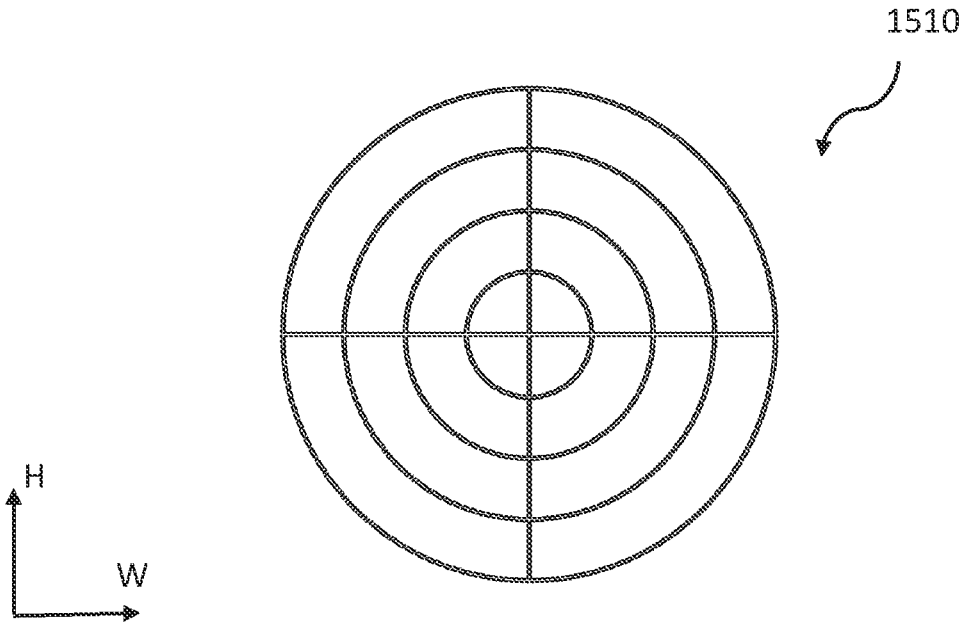

[Fig. 27A]
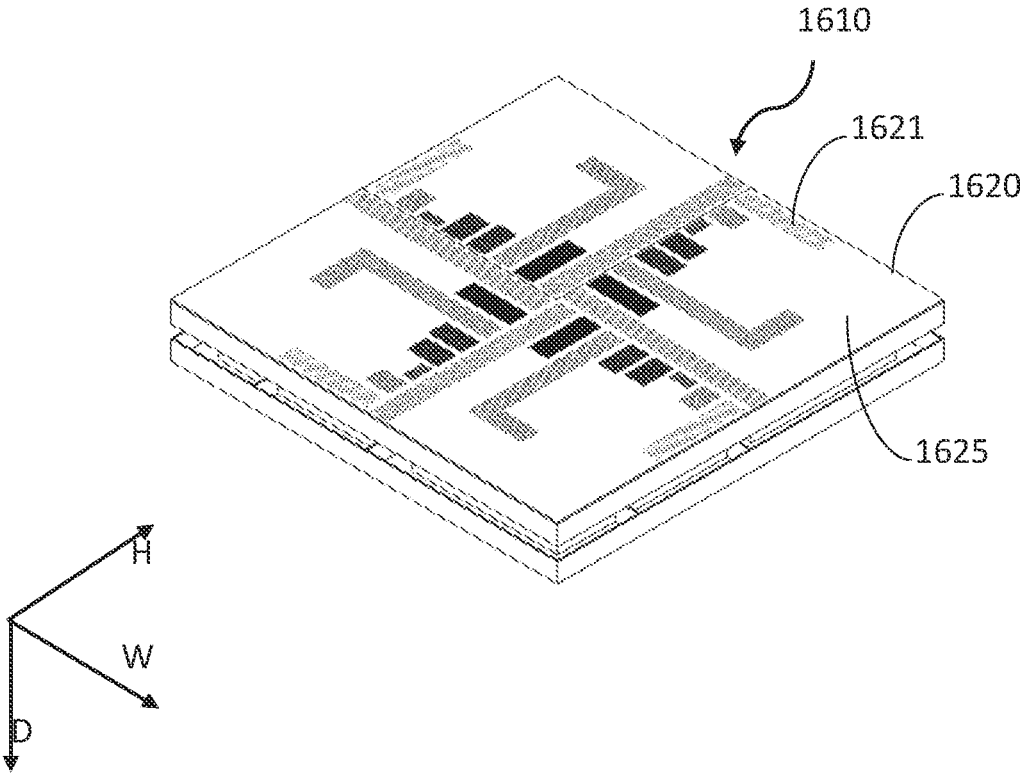
[Fig. 27B]
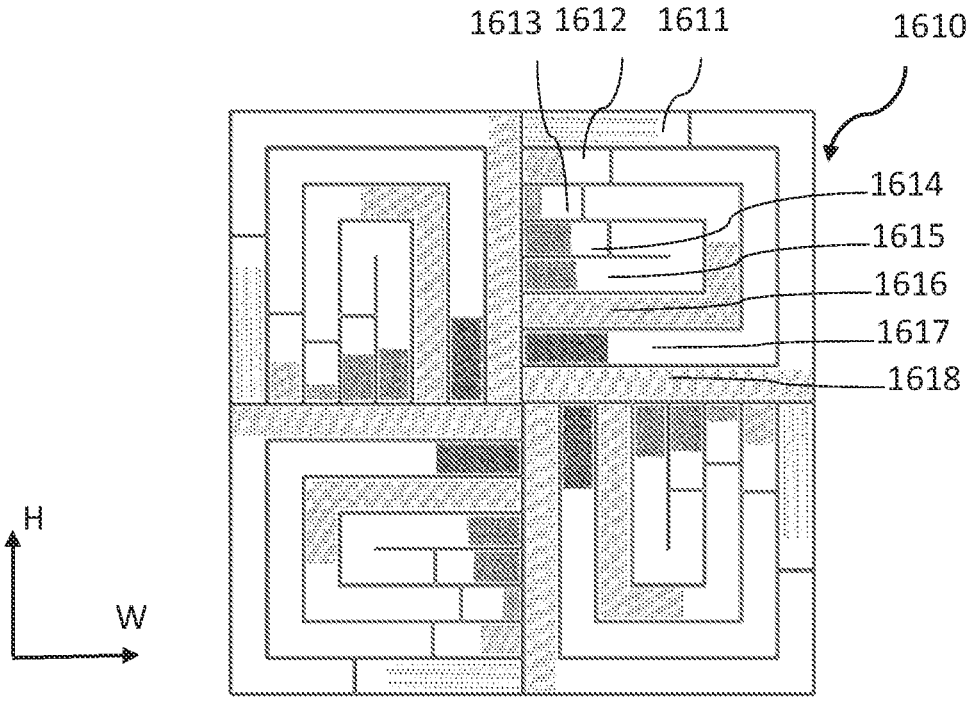

[Fig. 28]
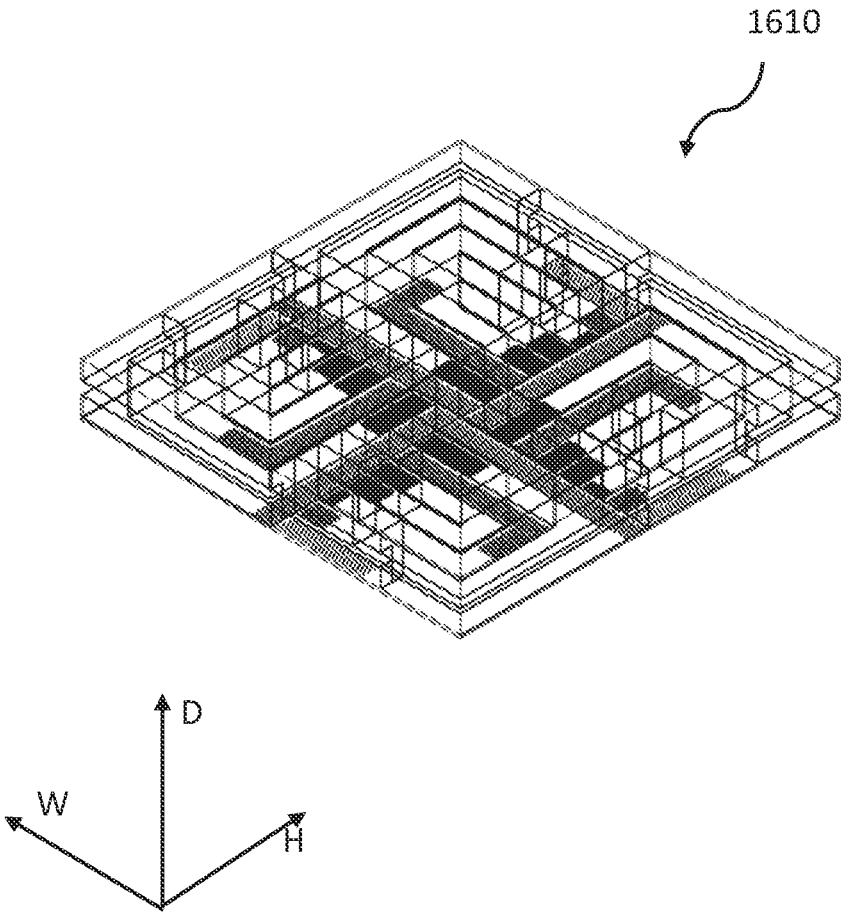

[Fig. 29A]
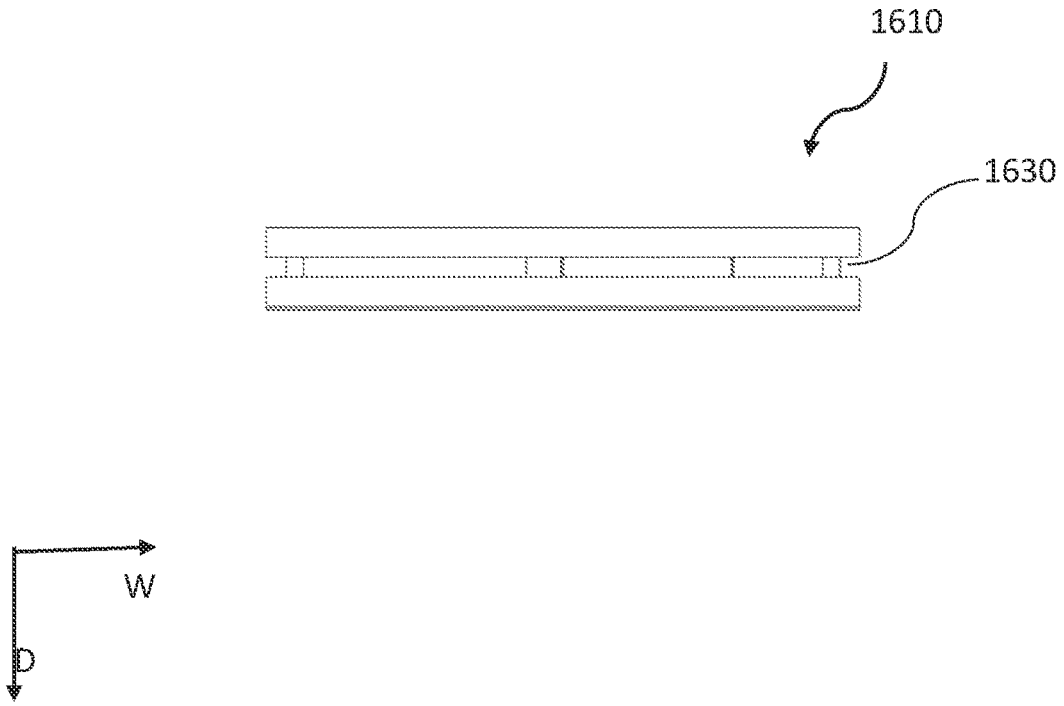
[Fig. 29B]
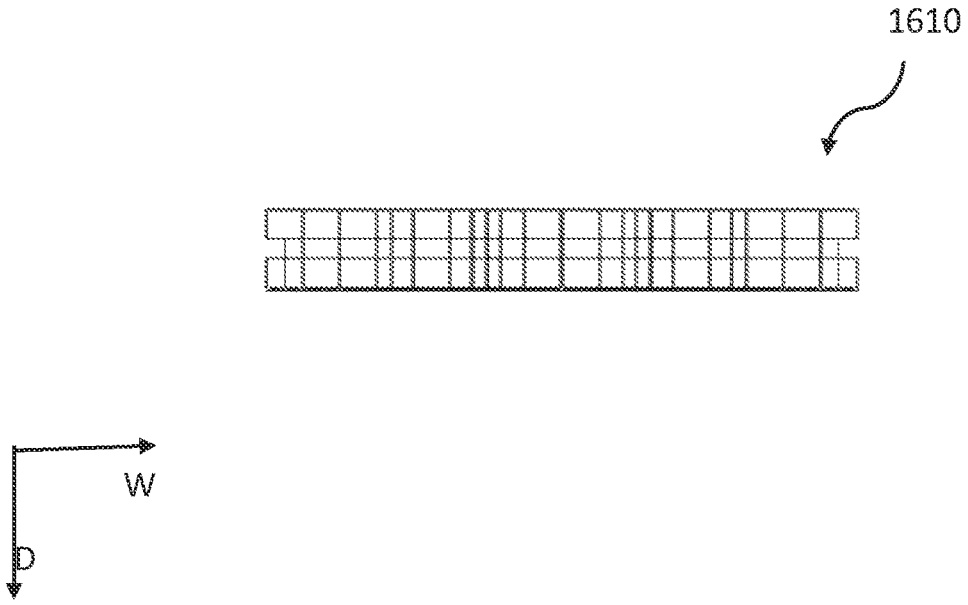

[Fig. 30A]
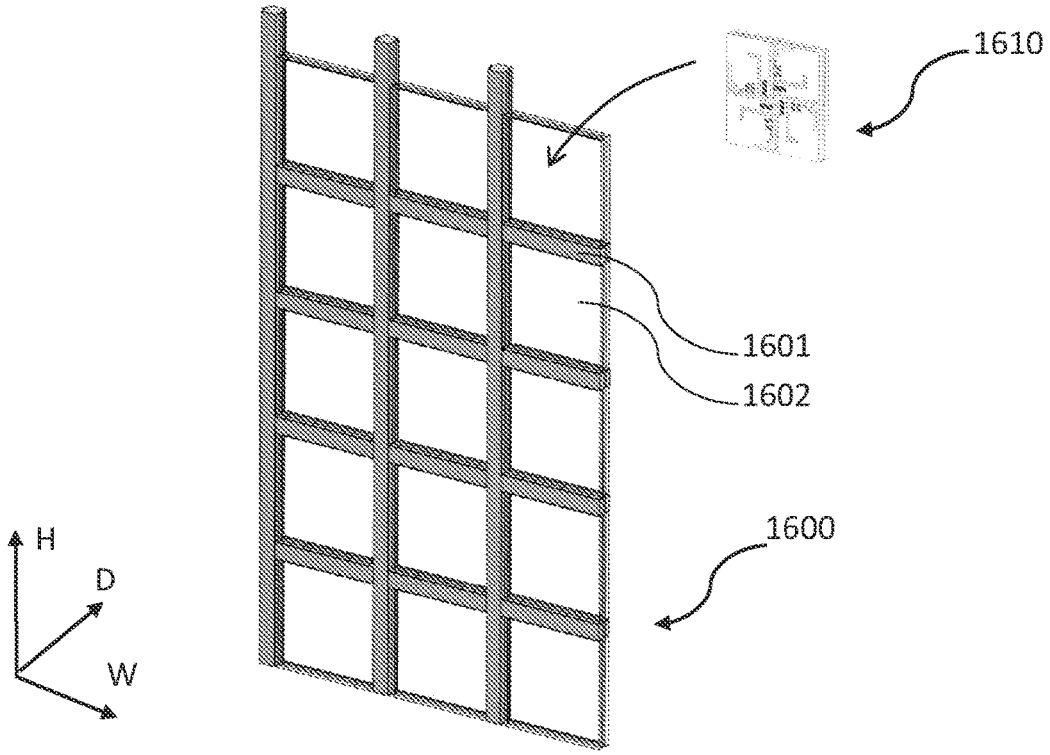
[Fig. 30B]
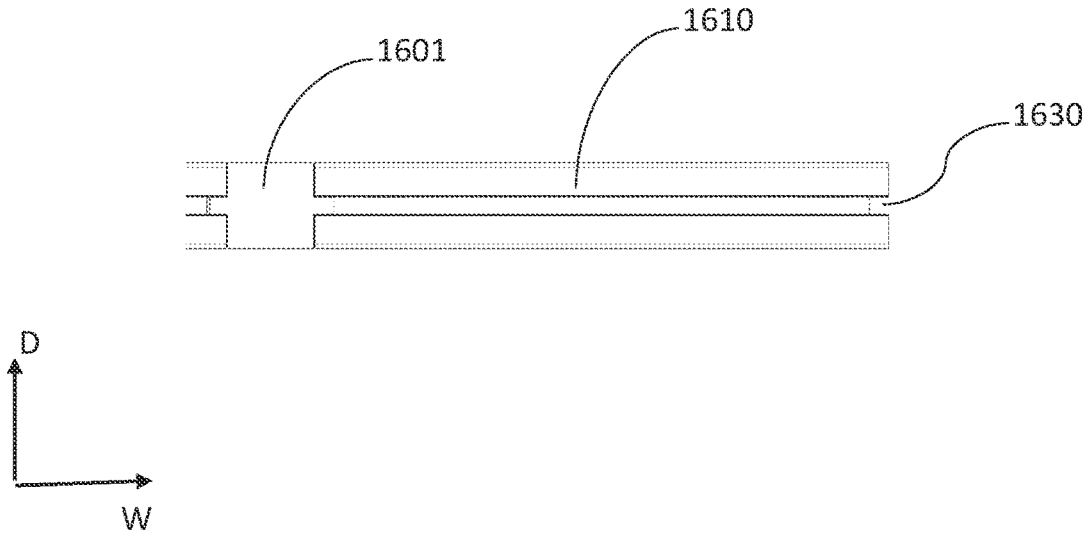

[Fig. 31A]
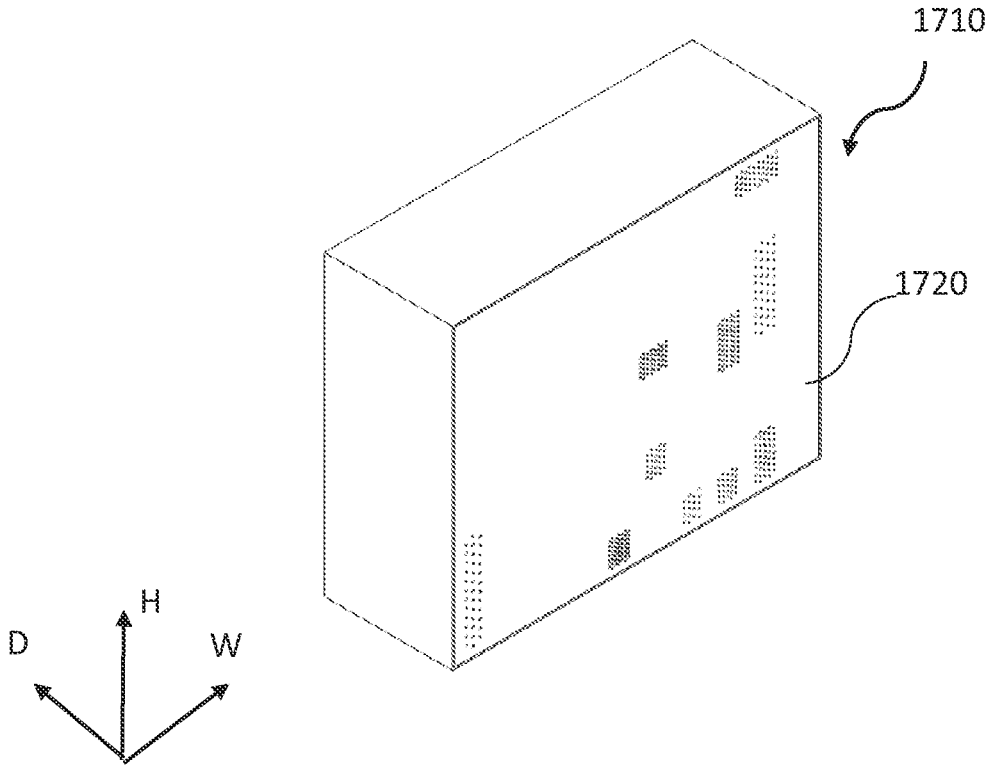
[Fig. 31B]
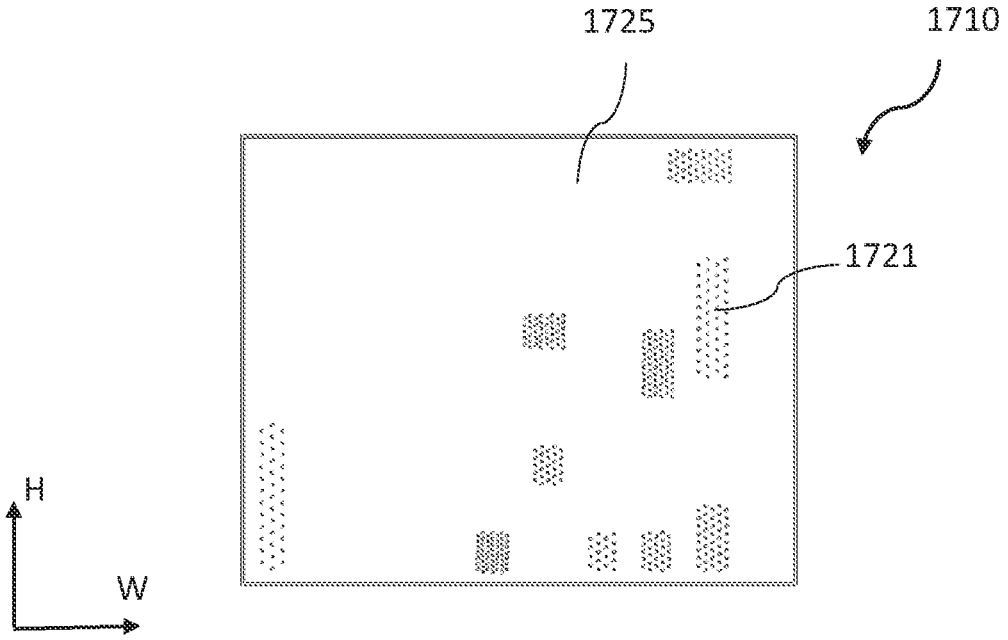

[Fig. 32A]
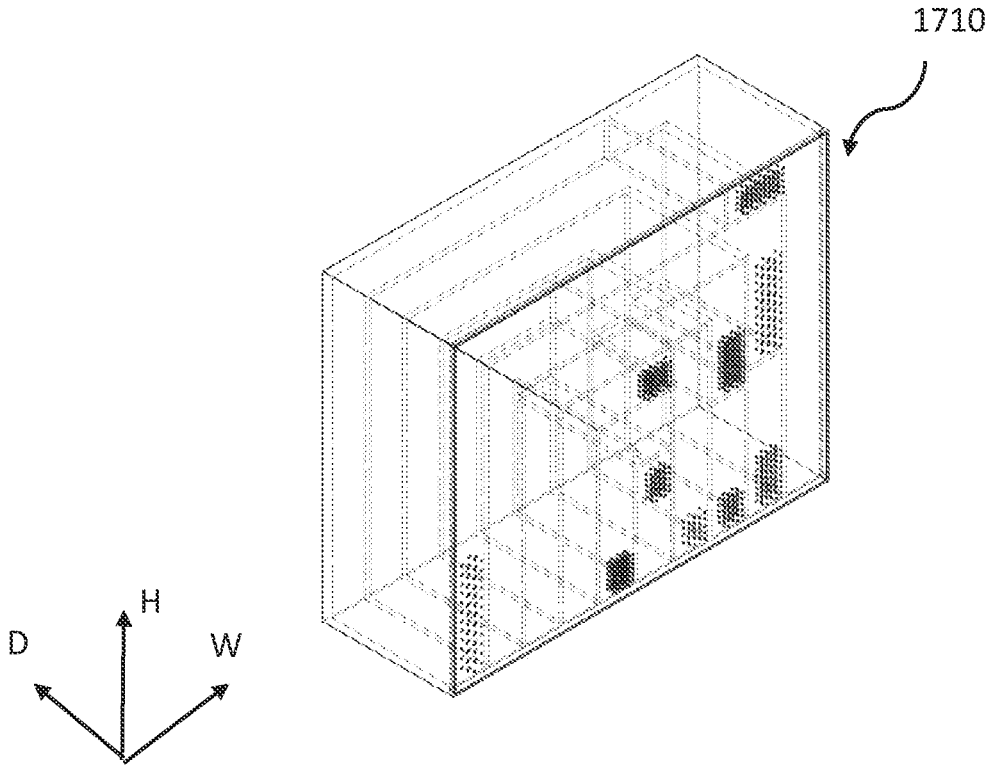
[Fig. 32B]
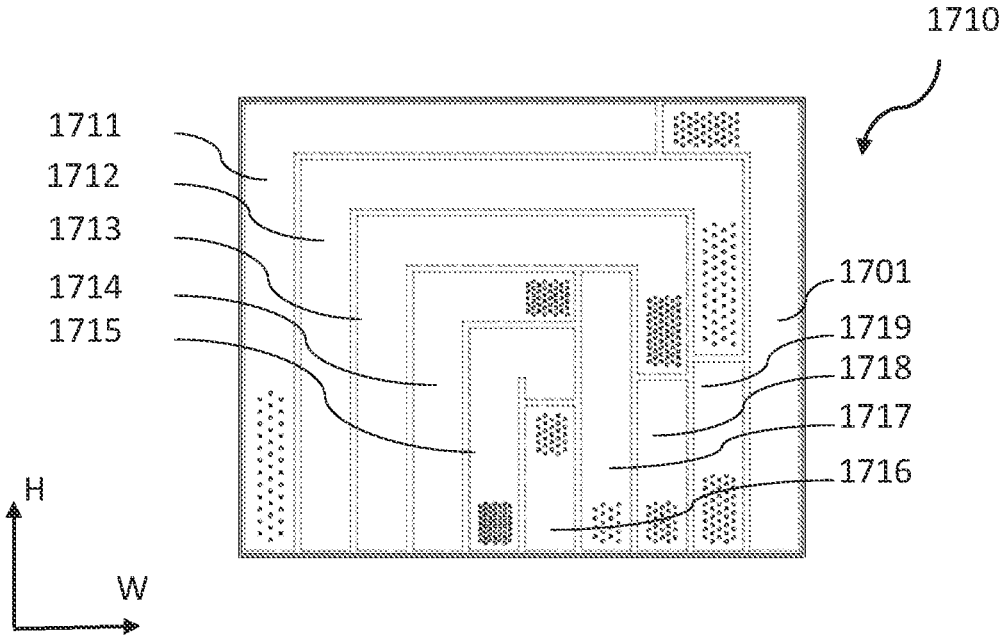

SOUND ABSORBER, SOUND ABSORBING PANEL AND SOUND ABSORBING WALL

CROSS-REFERENCE TO RELATED APPLICATION

This application is a Continuation Application of No. PCT/JP2022/26161, filed on Jun. 30, 2022, and the PCT application is based upon and claims the benefit of priority from Japanese Patent Application No. 2021-129497, filed on Aug. 6, 2021, Japanese Patent Application No. 2021-196557, filed on Dec. 2, 2021, and Japanese Patent Application No. 2022-036141, filed on Mar. 9, 2022, the entire contents of which are incorporated herein by reference.

TECHNICAL FIELD

The present disclosure relates to technology for reducing sound by absorbing sound.

BACKGROUND

Suppression of noise generated in railways, expressways, construction sites, indoor spaces, etc. is one of the important social issues. Japanese Patent Application Publication 2017-115572 discloses installing a soundproof panel using a sound absorber next to a noise source in order to suppress noise caused by vehicles traveling on roads and railroad tracks. On the other hand, there is a demand for more effective noise reduction, especially for low-frequency noise.

Wu (2019) [Wu, F., Xiao, Y., Yu, Di., Zhao, H., Wang, Y., & Wen, J. (2019). Low-frequency sound absorption of hybrid absorber based on micro-perforated panel and coiled-up channels. Applied Physics Letters, 114(15). https://doi.org/10.1063/1.5090355] proposes a sound absorbing structure including an S-shaped waveguide folded twice in a 180-degree direction. The thickness of this sound absorbing structure is about ⅓ times the length of the waveguide. Therefore, according to this structure, it is possible to effectively reduce the sound in the low frequency band while suppressing the thickness of the sound absorber.

The sound absorbing structure described in Wu (2019) exhibits a sound absorbing effect by having a waveguide extending in the incident direction of sound waves. Therefore, if the waveguide is lengthened in order to efficiently absorb sound in the low frequency band, the thickness of the sound absorbing structure in the incident direction of the sound wave will increase. On the other hand, in order to improve ease of installation of the sound absorber, it is required to reduce the thickness of the sound absorber.

BRIEF DESCRIPTION OF DRAWINGS

FIG. 1A is a diagram showing the structure of a sound absorbing unit;

FIG. 1B is a diagram showing the structure of a sound absorbing unit;

FIG. 2A is a diagram showing the structure of a sound absorbing unit;

FIG. 2B is a diagram showing the structure of a sound absorbing unit;

FIG. 3A is a diagram showing the structure of a chamber member;

FIG. 3B is a diagram showing the structure of a chamber member;

FIG. 4A is a diagram showing the structure of a chamber member;

FIG. 4B is a diagram showing the structure of a chamber member;

FIG. 5 is a diagram for explaining the function of the sound absorbing unit;

FIG. 6 is a diagram showing a usage example of the sound absorbing unit;

FIG. 7 is a diagram showing a usage example of the sound absorbing unit;

FIG. 8 is a diagram showing a configuration example of a design device;

FIG. 9 is a diagram showing design processing of a sound absorbing unit by a design device;

FIG. 10A is a diagram showing a modification of the structure of the sound absorbing unit;

FIG. 10B is a diagram showing a modification of the structure of the sound absorbing unit;

FIG. 11A is a diagram showing a modification of the structure of the sound absorbing unit;

FIG. 11B is a diagram showing a modification of the structure of the sound absorbing unit;

FIG. 12A is a diagram showing a modification of the structure of the chamber member;

FIG. 12B is a diagram showing a modification of the structure of the chamber member;

FIG. 13A is a diagram showing a modification of the structure of the chamber member;

FIG. 13B is a diagram showing a modification of the structure of the chamber member;

FIG. 14 is a diagram showing a modification of the structure of the perforated plate;

FIG. 15A is a diagram showing a modification of the structure of the sound absorbing unit;

FIG. 15B is a diagram showing a modification of the structure of the sound absorbing unit;

FIG. 16A is a diagram showing a modification of the structure of the chamber member;

FIG. 16B is a diagram showing a modification of the structure of the chamber member;

FIG. 17A is a diagram showing the appearance of a modification of the sound absorbing unit;

FIG. 17B is a diagram showing the appearance of a modification of the sound absorbing unit;

FIG. 18A is a cross-sectional view showing the structure of a modification of the sound absorbing unit;

FIG. 18B is a cross-sectional view showing the structure of a modification of the sound absorbing unit;

FIG. 19A is a diagram showing the appearance of a modification of the sound absorbing unit;

FIG. 19B is a diagram showing the appearance of a modification of the sound absorbing unit;

FIG. 20A is a cross-sectional view showing the structure of a modification of the sound absorbing unit;

FIG. 20B is a cross-sectional view showing the structure of a modification of the sound absorbing unit;

FIG. 21A is a diagram showing the appearance of a modification of the sound absorbing unit;

FIG. 21B is a diagram showing the appearance of a modification of the sound absorbing unit;

FIG. 22A is a cross-sectional view showing the structure of a modification of the sound absorbing unit;

FIG. 22B is a cross-sectional view showing the structure of a modification of the sound absorbing unit;

FIG. 23A is a diagram showing the appearance of a modification of the sound absorbing unit;

FIG. 23B is a diagram showing the appearance of a modification of the sound absorbing unit;

FIG. 24A is a sectional view showing the structure of a modification of the sound absorbing unit;

FIG. 24B is a sectional view showing the structure of a modification of the sound absorbing unit;

FIG. 25A is a diagram showing the appearance of a modification of the sound absorbing unit;

FIG. 25B is a diagram showing the appearance of a modification of the sound absorbing unit;

FIG. 26A is a cross-sectional view showing the structure of a modification of the sound absorbing unit;

FIG. 26B is a cross-sectional view showing the structure of a modification of the sound absorbing unit;

FIG. 27A is a diagram showing the appearance and structure of a modification of the sound absorbing unit;

FIG. 27B is a diagram showing the appearance and structure of a modification of the sound absorbing unit;

FIG. 28 is a diagram showing the structure of a modification of the sound absorbing unit;

FIG. 29A is a diagram showing the structure of a modification of the sound absorbing unit;

FIG. 29B is a diagram showing the structure of a modification of the sound absorbing unit;

FIG. 30A is a diagram showing the structure of a sound absorbing wall using a modification of the sound absorbing unit;

FIG. 30B is a diagram showing the structure of a sound absorbing wall using a modification of the sound absorbing unit;

FIG. 31A is a diagram showing an overview of a modification of the sound absorbing unit; and FIG. 31B is a diagram showing an overview of a modification of the sound absorbing unit;

FIG. 32A is a diagram showing the structure of a modification of the sound absorbing unit; and FIG. 32B is a diagram showing the structure of a modification of the sound absorbing unit.

DETAILED DESCRIPTION

Hereinafter, examples of embodiments of the present invention will be described in detail based on the drawings. In addition, in the drawings for describing the embodiments, the repeated description of the same components will be omitted.

According to one aspect of the present disclosure, a sound absorber includes a plurality of cavities mutually different in at least one of shape and size. A wall of a first cavity included in the plurality of cavities includes a first region and a second region. A plurality of through-holes connecting an interior of the first cavity to an exterior of the first cavity is formed in the first region. No through-holes connecting the interior of the first cavity and the exterior of the first cavity is formed in the second region adjacent to the first region. A wall of a second cavity included in the plurality of cavities includes a third region and a fourth region. A plurality of through-holes connecting an interior of the second cavity to an exterior of the second cavity is formed in the third region. No through-holes connecting the interior of the second cavity and the exterior of the second cavity is formed in the fourth region adjacent to the third region. Size of through-holes in the first region is different from size of through-holes in the third region.

According to another aspect of the present disclosure, a sound absorber comprising a plurality of cavities different in at least one of shape and size. A wall of a first cavity included in the plurality of cavities includes a first region and a second region. A plurality of through-holes connecting an interior of the first cavity to an exterior of the first cavity is formed in the first region. No through-holes connecting the interior of the first cavity and the exterior of the first cavity is formed in the second region adjacent to the first region. A wall of a second cavity included in the plurality of cavities includes a third region and a fourth region. A plurality of through-holes connecting an interior of the second cavity to an exterior of the second cavity is formed in the third region. No through-holes connecting the interior of the second cavity and the exterior of the second cavity is formed in the fourth region adjacent to the third region. Density of through-holes in the first region is different from density of through-holes in the third region.

(1) Configuration of Sound Absorbing Unit

(1-1) Basic Configuration of Sound Absorbing Unit

A basic configuration of the sound absorbing unit 10 will be described. The sound absorbing unit 10 corresponds to a sound absorber that has a specific sound absorbing structure. The sound absorber has a sound absorbing effect of reducing the sound pressure of reflected sound and transmitted sound by converting the energy of sound waves traveling toward the sound absorbing unit 10 into other energy or canceling it. FIG. 1A and FIG. 1B are a perspective view and a front view, respectively, showing the structure of the sound absorbing unit according to the embodiment. FIG. 2A and FIG. 2B are a side view and a bottom view, respectively, showing the structure of the sound absorbing unit according to the embodiment.

In the following description, "D direction" is the depth direction (thickness direction) of the sound absorbing unit 10. The sound absorbing unit 10 mainly absorbs sound waves traveling in the D direction. The "H direction" is a direction substantially perpendicular to the D direction and is the height direction of the sound absorbing unit 10. The "W direction" is a direction orthogonal to the "D direction" and the "H direction" and is the width direction of the sound absorbing unit 10. The sound absorbing unit 10 has a plurality of cavities (hereinafter referred to as "waveguides") through which sound waves can enter, and each waveguide functions as a resonator.

As shown in FIGS. 1A and 1B, the sound absorbing unit 10 has a perforated plate 20, which is a plate member having through-holes, and a chamber member 40 that is combined with the perforated plate 20 to form a cavity. The surface of the perforated plate 20 has perforated regions 21 to 27 each having a plurality of through-holes and non-perforated regions 31 to 36 having no through-holes. The sound absorbing unit 10 has a polygonal (specifically hexagonal) shape as viewed from the −D direction.

FIGS. 3A and 3B are respectively a perspective view and a front view showing the structure of the chamber member according to the embodiment. FIGS. 4A and 4B are a side view and a bottom view, respectively, showing the structure of the chamber member according to the embodiment. The chamber member 40 has spaces 41-44 separated from each other by partition walls 45-47. By providing the perforated plate 20 so as to cover the chamber member 40 from the −D direction side, the spaces 41 to 44 become waveguides whose walls are formed by the chamber member 40 and the perforated plate 20, respectively. Specifically, space 41 is covered by perforated region 21, non-perforated region 31 adjacent to perforated region 21, and perforated region 22 not adjacent to perforated region 21 but adjacent to non-perforated region 31. Space 42 is covered by non-perforated region 32, perforated region 23, non-perforated region 33 and perforated region 24. Space 43 is covered by perforated region 25 and non-perforated region 34 adjacent to perforated region 25. Space 44 is covered by non-perforated region 35, perforated region 26, non-perforated region 36 and perforated region 27.

Hereinafter, the waveguide having the space 41 is called the waveguide 11, the waveguide having the space 42 is called the waveguide 12, the waveguide having the space 43 is called the waveguide 13, and the waveguide having the space 44 is called the waveguide 14. The waveguides 11 and 12 are adjacent to each other via a partition 45, the waveguides 12 and 13 are adjacent to each other via a partition 46, and the waveguides 13 and 14 are adjacent to each other via a partition wall 47. That is, the partition walls 45 to 47 divide the inside of the sound absorbing unit 10 into a plurality of waveguides.

The partition walls 45-47 extend in substantially the same direction. Therefore, each of the waveguides 11 to 14 has a substantially trapezoidal contour as viewed in the −D direction, and extends substantially parallel to each other. The waveguides 11 and 12 have different shapes and sizes, and the waveguides 13 and 14 have different shapes and sizes. The waveguides 12 and 13 have substantially the same shape and size of the cavities, but differ in the arrangement of the through-holes formed in the respective walls. The waveguides 11 and 14 have substantially the same cavity shape and size, but differ in the arrangement of through-holes formed in the respective walls.

In addition, the sound absorbing unit 10 may be configured as a whole, or may be configured by combining a plurality of members. For example, the sound absorbing unit 10 may be configured by combining the perforated plate 20 and the chamber member 40, or the perforated plate 20 and the chamber member 40 may be integrated. Further, for example, the sound absorbing unit 10 may be configured by combining members that configure each waveguide. In other words, the sound absorbing unit 10 may have a plurality of waveguides, and the perforated region and the non-perforated region may be present in the member forming the wall of each waveguide. The interior and exterior of each waveguide are communicated through a plurality of through-holes present in the through-hole region, allowing ventilation.

Specifically, the inside and the outside of the waveguide 11 are communicated with each other through a plurality of through-holes formed in the through-hole regions 21 and 22, and can be ventilated. On the other hand, in the portion covered with the non-perforated region 31, ventilation between the inside and the outside of the waveguide 11 is not possible. Similarly, the interior and exterior of waveguide 12 communicate through a plurality of through-holes formed in perforated regions 23 and 24. The inside and outside of waveguide 13 communicate with each other through a plurality of through-holes formed in through-hole region 25. The inside and outside of the waveguide 14 communicate with each other through a plurality of through-holes formed in the through-hole regions 26 and 27.

The perforated surface of the perforated plate 20 forming the walls of the waveguides 11 to 14 is exposed as viewed from the −D direction. A sound wave arriving from the −D direction with respect to the sound absorbing unit 10 and incident on the perforated plate 20 enters the inside of each waveguide through a plurality of through-holes formed in the perforated region, travels in the area covered with the non-perforated region to the direction D, and is reflected by the side surface of the chamber member 40. Each perforated region of the perforated plate 20 functions as an acoustic impedance matching member, and the waveguides 11 to 14 function as resonators having mutually different resonance characteristics. Therefore, according to the sound absorbing unit 10, a sound absorbing effect can be obtained in a wide frequency band compared to a sound absorber having a single waveguide. The sound absorption characteristic of the sound absorbing unit 10 in this embodiment is represented by, for example, a sound absorption coefficient for each frequency or an acoustic impedance. The sound absorbing unit 10 may be designed so that the frequency bands of the sound waves absorbed by the waveguides do not overlap each other, or the sound absorbing unit 10 may be designed such that the frequency bands of the sound waves absorbed by the waveguides partially overlap.

The volume of waveguide 11 is smaller than the volume of waveguide 12 and the volume of waveguide 13 is larger than the volume of waveguide 14. By making the sizes of the plurality of waveguides different in this way, the resonance characteristics of those waveguides can be made different. The distance between the perforated regions 21 and 22 on the surface of the perforated plate 20 (length L1 in FIG. 1B) is longer than the length of the waveguide 11 in the direction normal to the surface of the perforated plate 20 (thickness L2 in FIG. 2B). With such a configuration, in the waveguide 11, the length of the path along which the sound wave travels in a direction non-parallel to the D direction is increased, thereby improving the sound absorption coefficient in the low frequency band, while the depth (i.e., thickness) in the D direction of the sound absorbing unit 10 can be reduced. In addition, the length of the non-perforated region 34 in the direction connecting the center of gravity of the perforated region 25 and the center of gravity of the non-perforated region 34 on the surface of the perforated plate 20 (length L3 in FIG. 1B) is longer than the length of the waveguide 13 in the direction normal to the surface of the perforated plate 20 (thickness L4 in FIG. 2B). With such a configuration, in the waveguide 13, the length of the path along which the sound wave travels in a direction non-parallel to the D direction is increased, thereby improving the sound absorption coefficient in the low frequency band and reducing the thickness of the sound absorbing unit 10.

The waveguide 11 has an excellent sound absorption coefficient in a high frequency band compared to the waveguide 13. On the other hand, the waveguide 13 has an excellent sound absorption coefficient in a low frequency band compared to the waveguide 11. Here, in the portion of the perforated plate 20 that constitutes the wall of the waveguide 13, the through-holes are arranged at one location (that is, the perforated region 25). Such a configuration can improve the sound absorption coefficient of the waveguide 13 in a low frequency band as compared with the case where the through-holes are arranged in a plurality of locations. On the other hand, in the portion of the perforated plate 20 that constitutes the wall of the waveguide 11, the through-holes are distributed in a plurality of locations (that is, the perforated region 21 and the perforated region 22). With such a configuration, it is possible to improve the sound absorption coefficient of the waveguide 11 in a high frequency band as compared with the case where the through-holes are arranged in one place. As will be described later, it is possible to change the sound absorption characteristics of the waveguide by changing the parameters such as the size of each through-hole. However, the desired sound absorption characteristics can be achieved by appropriately designing the arrangement of the through-holes.

The sound absorbing unit 10 can be constructed using various materials because it exhibits sound absorbing performance depending on its shape and structure. The sound absorbing unit 10 is made of material such as resin, metal, silicon, rubber, polymer, paper, cardboard, wood, or non-woven fabric. However, the sound absorbing unit 10 may be made of materials other than these materials. Moreover, the sound absorbing unit 10 may be configured by combining a plurality of members made of different materials. For example, the perforated plate 20 and the chamber member 40 of the sound absorbing unit 10 may be made of different materials.

(1-2) Configuration of Perforated Plate

The configuration of the perforated plate 20 will be described. A plurality of through-holes are formed in each of the perforated regions 21 to 27 of the perforated plate 20. Note that the perforated plate 20 may be configured as a single body, or may be configured by combining a plurality of members. For example, the portion of the perforated plate 20 that covers each waveguide may be composed of a separate member, or each perforated region and each non-perforated region of the perforated plate 20 may be composed of a separate member. Alternatively, the perforated plate 20 may be composed of six triangular plate members. By constructing the perforated plate 20 as a whole, the manufacturing process of the perforated plate 20 can be simplified, and the manufacturing cost can be reduced. On the other hand, by configuring the perforated plate 20 by combining a plurality of members, the size of each member can be reduced. Therefore, even if the size of the member that can be manufactured is limited, a large perforated plate 20 can be produced.

The resonance characteristics of each waveguide depend on the shape of the waveguide and the shape parameters of the perforated plate combined with the waveguide (hereinafter referred to as "hole parameters"). Hole parameters include, for example:

- the area of the through-hole area (the area of the surface in which the holes are formed);
- thickness of perforated plate (dimension perpendicular to the surface);
- the size of the hole (for example, the diameter if the hole is circular);
- the ratio of the area of the holes to the surface of the perforated plate (hereinafter referred to as "hole occupancy");
- hole shape;
- number of holes;
- spacing between holes; and
- arrangement of holes.

By changing the hole parameters of the perforated plate, the acoustic impedance of the sound absorbing unit 10 can be adjusted. In addition, the perforated plate has the effect of lowering the Q value by thermoviscous resistance and enabling sound absorption in a wide frequency band. As a specific parameter example, for example, the lengths of the sound absorbing unit 10 in the H direction and the W direction are 10 cm to 50 cm, respectively, and the thickness of the sound absorbing unit 10 in the D direction is 2 cm to 10 cm. Further, when the thickness of the perforated plate 20 is 0.5 mm to 3 mm, the diameter of the holes present in the perforated plate is set to 0.3 mm to 3 mm. Then, by appropriately setting other parameters such as the number of holes in the perforated plate, it efficiently absorbs (reduces the sound pressure of) the 400 Hz to 1500 Hz sound that is the main component of the sound contained in human conversation. be able to. In this case, the average sound absorption coefficient of sound from 400 Hz to 1500 Hz by the sound absorbing unit 10 is higher than the average sound absorption coefficient of sound in other frequency bands (frequency band lower than 400 Hz and frequency band higher than 1500 Hz) by the sound absorbing unit 10. Also, by adjusting at least one of the shape and hole parameters of the waveguide, the sound absorbing characteristics of the sound absorbing unit 10 can be changed. For example, the sound absorbing unit 10 can be designed such that the average sound absorption coefficient for sounds of 1000 Hz to 4000 Hz is higher than the average sound absorption coefficient for sounds in other frequency bands. Further, for example, the sound absorbing unit 10 can be designed so as to efficiently absorb sounds of 200 Hz or more and 2500 Hz or less.

The hole parameters of the plurality of through-hole regions of the sound absorbing unit 10 may be different from each other. For example, the hole parameters of perforated region 21 and perforated region 22 may be optimized according to the sound absorption properties required for waveguide 11. The hole parameters of perforated region 23 and perforated region 24 may be optimized according to the sound absorption properties required for waveguide 12. The hole parameters of perforated region 25 may be optimized according to the sound absorption properties required for waveguide 13. The hole parameters of perforated region 26 and perforated region 27 may be optimized according to the sound absorption properties required for waveguide 14. That is, the through-holes that communicate the interior and exterior of one of the waveguides 11 to 14 and the through-holes that communicate the interior and exterior of the other waveguides may be different in at least one of the hole parameters or the arrangement of holes. Thereby, the sound absorbing unit 10 can achieve a high sound absorption coefficient in a wide frequency band. However, without being limited to this, the hole parameters of the plurality of perforated regions of the sound absorbing unit 10 may be common. As a result, the specifications of the holes of the perforated plate 20 can be unified, so that the manufacturing cost of the perforated plate 20 can be reduced.

Although the surface of the perforated plate 20 is planar in the example of the sound absorbing unit 10, the shape of the perforated plate 20 is not limited to this. For example, the surface of the perforated plate 20 may be curved or uneven.

(2) How to Use the Sound Absorbing Unit

How to use the sound absorbing unit will be explained. FIG. 5 is a diagram explaining the function of the sound absorbing unit according to the embodiment. As shown in FIG. 5, the sound absorbing unit 10 is installed at a position separated in the direction D from the noise source NS that emits the sound to be absorbed. Each waveguide included in the sound absorbing unit 10 absorbs frequency components corresponding to the shape (for example, length or volume) of the waveguide and the hole parameter of the perforated plate, among the sound waves traveling in the direction D from the noise source NS. As a result, the sound pressure of the sound wave arriving from the noise source NS to the position on the side more advanced in D direction than the sound absorbing unit 10 is greatly reduced compared to the case where the sound absorbing unit 10 is not installed.

FIG. 6 shows the example of use of the sound absorbing unit in the embodiment. As shown in FIG. 6, by installing a plurality of sound absorbing units 10 in combination, it is possible to further reduce the sound pressure of the sound emitted from the noise source NS. A plurality of sound absorbing units 10 are installed in combination so as to form a sound absorbing wall 1 that blocks sound waves traveling from the noise source NS toward the human HMa. Specifically, the sound absorbing wall 1 is configured by attaching the plurality of sound absorbing units 10 to the support plate 50 so that the surfaces of the perforated plates 20 of the plurality of sound absorbing units 10 (surfaces on which the through-holes are formed) are exposed as viewed from the same direction. Since the sound absorbing wall 1 has a sound insulating effect, by installing the sound absorbing wall 1, the sound pressure of the sound wave emitted from the noise source NS is greatly reduced when passing through the sound absorbing wall 1. Thus, the noise felt by the human being HMa who is behind the wall 1 can be reduced.

In addition, since the sound absorbing wall 1 has a sound absorbing effect, by installing the sound absorbing wall 1, compared to the case where a wall made up of conventional members (for example, a concrete wall) is installed at the same position, the volume of the sound reflected by the wall can be reduced. Therefore, the sound pressure of the sound wave emitted from the noise source NS is greatly reduced when reflected by the sound absorbing wall 1, and the noise felt by the human HMb on the opposite side of the noise source NS from the sound absorbing wall 1 can be reduced. In addition, when the sound absorbing wall 1 is installed, the volume of the sound going around the wall due to diffraction becomes smaller than when the wall made of the conventional member is installed at the same position. Due to this effect, the noise felt by the human HMa behind the wall can be reduced.

Although the use of the sound absorbing wall 1 is not limited, the sound absorbing wall 1 can be used for the following uses, for example. The sound absorbing wall 1 can suppress noise generated by automobiles or trains by being arranged around roads or railroad tracks. The sound absorbing wall 1 can suppress construction noise by being arranged at the construction site. The sound absorbing wall 1 can suppress noise in the building by being used as a wall of the building. The sound absorbing wall 1 is arranged around a person's work place (for example, a work desk) to suppress the noise perceived by the worker and suppress the sound leakage of the noise emitted by the worker to the surroundings. As for how to place the sound absorbing wall 1 around the work place, the sound absorbing wall 1 may be placed so as to surround the work place on all four sides, or the sound absorbing wall 1 may be placed so as to surround three directions excluding the direction of the doorway. Alternatively, only one sound absorbing wall 1 may be placed. Alternatively, a work booth may be configured by closing the ceiling of the work place surrounded by the sound absorbing walls 1 on all four sides.

In this embodiment, the perforated plate 20 and the chamber member 40 can each be made of a light-transmissive material. As the light-transmitting material, for example, glass or resin material such as acrylic can be used, but the material is not limited to these. In this case, at least the outer shell of the sound absorbing unit 10 should be light transmissive. That is, portions of the chamber member 40 other than the partition walls 45 to 47 and the perforated plate 20 are made of a transparent or translucent material. The sound absorbing unit 10 having such a configuration is a sound absorber suitable for use on a wall surface having light transmission properties such as glass or acrylic.

For example, consider a case where a screen made of glass or a low partition is used as the support plate 50 in FIG. 6. When the sound absorbing unit 10 is not attached to the support plate 50, the support plate 50 is light transmissive, so the human HMa can be seen through the support plate 50 and visually recognized by the human HMb. On the other hand, if a sound absorber that does not have optical transparency is attached to the support plate 50, the human HMb cannot visually recognize the human HMa. That is, the attachment of the sound absorber impairs the functionality and design of the support plate 50. On the other hand, when the light-transmitting sound absorbing unit 10 is attached to the support plate 50, the human HMb can visually recognize the human HMa, and the functionality and design of the support plate 50 are maintained.

By attaching the translucent sound absorbing unit 10 to the wall surface, it is possible to change the transparency of the wall surface to which it is attached. For example, when no sound absorbing unit is attached to the support plate 50 made of glass, the human HMa and the human HMb on opposite sides of the support plate 50 can visually recognize each other's actions. On the other hand, when the translucent sound absorbing unit 10 is attached to the support plate 50, the transparency of the sound absorbing wall 1 composed of the sound absorbing unit 10 and the support plate 50 is lower than that of the support plate 50. As a result, the human HMa and the human HMb can visually recognize each other's existence, but cannot visually recognize the details of their actions. According to such a configuration, it is possible to protect privacy between persons on opposite sides of the support plate 50 from each other. The translucent sound absorbing unit 10 can be realized by using a translucent material for the perforated plate 20 or roughening the surface of the perforated plate 20.

Moreover, the sound absorbing unit 10 can also be used on a wall surface that does not have light transmittance. For example, consider the case of using a screen that is opaque and has a characteristic pattern on its surface as the support plate 50 in FIG. 6. In this case, if a sound absorber that does not have light transmittance is attached to the support plate 50, the characteristic pattern will not be visible and the design will be impaired. However, when the light-transmissive sound absorbing unit 10 is attached to the support plate 50, the characteristic pattern becomes visible and the design is maintained.

In addition, in FIGS. 1A and 1B, the perforated plate 20 is drawn opaquely for the sake of simplification of the drawing. However, in the configuration in which the perforated plate 20 is transparent or translucent, the partition walls 45 to 47 are visible through the perforated plate 20 as viewed from the same angles (oblique direction and –D direction) as these figures. Moreover, the partition walls 45 to 47 may be made of a light-transmissive material. Thereby, the visibility through the sound absorbing unit 10 can be further improved.

FIG. 7 is a diagram showing another usage example of the sound absorbing unit according to the embodiment. As shown in FIG. 7, the sound pressure in the space SP can be reduced by attaching the plurality of sound absorbing units 10 to the wall surface 60 of the space SP. Specifically, a sound absorbing panel is configured by adding to the sound absorbing unit 10 a mounting structure that allows the sound absorbing unit 10 to be mounted on the wall surface 60. A plurality of sound absorbing panels are mounted side by side on the wall surface 60 so that the surfaces of the perforated plates 20 of the plurality of sound absorbing units 10 (surfaces on which the through-holes are formed) are exposed as viewed from the direction normal to the wall surface 60. Since the sound absorbing panel has a mounting structure, the sound absorbing unit 10 can be easily mounted on or removed from the wall surface 60. As the mounting structure, for example, a double-sided tape, a screw fixture, a magnet, a hook-and-loop fastener, or a suction cup can be used.

If the sound absorbing unit 10 is not installed in the space SP, the sound of the conversation between the human HMc and the human HMd in the space SP reverberates within the space SP and interferes with the conversation between the human HMe and the human HMf in the same space SP. On the other hand, by attaching the sound absorbing unit 10 to the wall surface 60, the sound incident on the wall surface 60 is absorbed, and the echo of the sound in the space SP can be suppressed. In addition, it is possible to suppress the sound leaking from inside the space SP to the outside of the space SP. Furthermore, by designing the shape of the waveguide and the hole parameters of the perforated plate 20 so that the sound absorbing unit 10 has the desired sound absorption characteristics, the sound of a specific frequency band in the space SP is can be greatly reduced. Thereby, the resonance of the sound in the space SP can be adjusted.

As described above, at least the outer shell of the sound absorbing unit 10 can be made light transmissive. Therefore, for example, when the wall surface 60 is made of a light-transmitting material such as glass, it is possible to particularly prevent deterioration of the functionality and design of the space SP. Also, the mounting structure for mounting the sound absorbing unit 10 on the wall surface 60 may be made of a material having light transmittance. In addition, regardless of whether the mounting structure has light transmittance or not, the mounting structure may be provided not on the entire mounting surface of the sound absorbing unit 10 but only on a part of the mounting surface. These configurations can further suppress deterioration of the functionality and design of the space SP. However, the configuration of the sound absorbing unit 10 is not limited to this example, and the sound absorbing unit 10 does not have to be light transmissive. For example, by arranging the sound absorbing unit 10 having light transmittance and the sound absorbing unit 10 not having light transmittance side by side, it is possible to expand the variation of the design of the wall surface.

(3) Design Method of Sound Absorbing Unit

(3-1) Configuration of Design Device

A configuration of a design device that executes processing for designing the sound absorbing unit 10 will be described. FIG. 8 is a diagram illustrating a configuration example of a design device. As shown in FIG. 8, the design device 210 includes a storage device 211, a processor 212, an input/output interface 213, and a communication interface 214.

The storage device 211 is configured to store a program and data. The storage device 211 is, for example, a combination of a ROM (read only memory), a RAM (random access memory), and a storage (for example, a flash memory or a hard disk). The programs include, for example, an OS (Operating System) program and an application (for example, web browser) program that executes information processing. Data includes, for example, data and databases referred to in information processing, and data obtained by executing information processing (that is, execution results of information processing). The programs and data stored by the storage device 211 may be provided via a network, or may be provided by being recorded on a computer-readable recording medium.

The processor 212 implements the functions of the design device 210 by executing programs stored in the storage device 211 and processing data. At least part of the functions of the design device 210 may be realized by dedicated hardware (for example, ASIC (application specific integrated circuit) or FPGA (field-programmable gate array)).

The input/output interface 213 has a function of receiving an input corresponding to a user's operation on an input device connected to the design device 210 and a function of output information to an output device connected to the design device 210. The input device is, for example, a keyboard, a pointing device, a touch panel, or a combination thereof. The output device is, for example, a display that displays images or a speaker that outputs audio. A communication interface 214 controls communication between the design device 210 and an external device (e.g., server).

(3-2) Design Process

Processing for designing the sound absorbing unit 10 will be described. FIG. 9 is a diagram showing design processing of the sound absorbing unit by the design device.

The processing shown in FIG. 6 is implemented by executing a program stored in the storage device 211 by the processor 212 of the design device 210. However, at least part of the processing shown in FIG. 6 may be realized by dedicated hardware. The processing shown in FIG. 6 is started in response to the user's input to the design device 210 to start designing the sound absorbing unit 10. However, the conditions for starting the process shown in FIG. 6 are not limited to this.

In S100, the design device 210 acquires fixed values that can be set as design parameters of the sound absorbing unit 10. For example, the processor 212 acquires fixed values by accepting user input or by reading a file in which fixed values are stored. Design parameters of the sound absorbing unit 10 include, for example, at least one of the following:

- Size of sound absorbing unit 10 (dimensions in H, D, and W directions);
- Number of waveguides;
- Length or volume of waveguide (dimension in H direction or W direction);
- Depth of waveguide (dimension in D direction);
- Shape of waveguide;
- The shape of the side wall included in the sound absorbing unit 10; and
- Hole parameters of the perforated plate.

As an example, in the following description, it is assumed that the size of the sound absorbing unit 10, the number of waveguides, and the shape of the side wall are acquired as fixed values in S100. Then, the hole parameters of the perforated plate, the size of the waveguide, and the shape of the waveguide shall be treated as variables.

In S101, the design device 210 acquires the domain of the design parameter treated as a variable (the possible range of the variable). For example, the processor 212 acquires the domain of the variable by accepting user input or by reading a file in which the domain of the variable is stored.

In S102, the design device 210 constructs an analysis model of the sound absorbing unit 10. Specifically, the processor 212 uses the fixed values acquired in S100 and the values of the variables selected from the domain acquired in S101 as design parameters for the analysis model of the sound absorbing unit 10.

In S103, the design device 210 evaluates the sound absorption characteristics of the analysis model. Specifically, the processor 212 obtains an evaluation value of the sound absorption characteristics of the analysis model by analyzing the sound absorption characteristics by acoustic simulation using the analysis model constructed in S102. For example, the design device 210 acquires the average sound absorption coefficient or average reflectance in each of multiple frequency bands. In addition, the evaluation method of the sound absorption property is not limited to this. For example, the design device 210 may obtain the average transmittance in each of multiple frequency bands.

In S104, the design device 210 determines the search state. Specifically, the processor 212 determines whether the domain acquired in S101 has been searched for each variable (that is, the construction and the evaluation of the sound absorption characteristics of the analysis model using all the numerical values that can be selected from the domain have been ended) or not.

If it is determined that the search has not ended in S104, the process returns to S102, the design device 210 selects new variable values from the domain acquired in S101, and constructs the analysis model and evaluates the sound absorption characteristics again. On the other hand, if it is determined in S104 that the search has ended, the process proceeds to S105.

In S105, the design device 210 extracts the optimum values of the variables. Specifically, the processor 212 extracts, as the optimal value, the numerical value of the design parameter corresponding to the analysis model showing the highest evaluation value in the repeatedly performed evaluation of the sound absorption characteristics in S103. For example, when 400 Hz to 1000 Hz is specified as the frequency band for sound absorption, the numerical value of the design parameter of the analysis model with the highest average sound absorption coefficient in 400 Hz to 1000 Hz is extracted as the optimum value. By designing the sound absorbing unit 10 using the optimum values thus extracted, it is possible to manufacture the sound absorbing unit 10 having excellent sound absorbing characteristics in the range of 400 Hz to 1000 Hz. The frequency band for sound absorption may be specified in response to user input.

After S105, the processing flow of FIG. 6 ends. In the process flow of FIG. 6, the processes of S100 and S101 may be performed in reverse order, or may be performed in parallel. Further, the design device 210 may output information indicating the evaluation result of the analysis model instead of extracting the optimum values of the variables in S105 or in addition to the processing of S105. For example, the design device 210 may output information indicating the sound absorption characteristics of each of the plurality of analysis models constructed in S102, or output information indicating the sound absorption characteristics of the analysis model corresponding to the optimum value extracted in S105. The information output by the design device 210 may be numerical values indicating sound absorption characteristics, or may be images output to a display device.

In the above description, the case where the sound absorbing unit 10 is designed so as to maximize the sound absorbing performance in a predetermined frequency band has been described. However, without being limited to this, the sound absorbing unit 10 may be designed so as to achieve a designated sound absorbing performance in a predetermined frequency band. For example, there may be a case where it is desired to suppress the echo of a person's voice in a space, but leave some echo so that the voice can be heard naturally. In this case, in S105, the design device 210 extracts the numerical value of the design parameter of the analysis model whose average sound absorption coefficient in the specified frequency band of 400 Hz to 1000 Hz is closest to the specified value (for example, 0.5) as the optimum value. Further, for example, there may be a case where it is desired to suppress echoes of low frequencies in a space, but to leave echoes of high frequencies. In this case, in S105, the design device 210 may extract, as the optimum values, the numerical values of the design parameters of the analysis model in which the average sound absorption coefficient of 100 Hz to 500 Hz is higher than the average sound absorption coefficient of 800 Hz to 2000 Hz and the difference between the average sound absorption coefficients is the largest.

(4) Modifications

(4-1) Modification 1 of Sound Absorbing Unit

A modification of the configuration of the sound absorbing unit will be described. The sound absorbing unit 10 in the description of the above embodiment can be replaced with a sound absorbing unit of a modified example described below. FIGS. 10A and 10B are a perspective view and a front view, respectively, showing the structure of a sound absorbing unit according to a modification. FIGS. 11A and 11B are a side view and a bottom view, respectively, showing the structure of a sound absorbing unit according to a modification. FIGS. 12A and 12B are respectively a perspective view and a front view showing the structure of a chamber member according to a modification. FIGS. 13A and 13B are a side view and a bottom view, respectively, showing the structure of the chamber member according to the modification. In the sound absorbing unit 10 described with reference to FIGS. 1 to 4, the plurality of partition walls extend substantially in the same direction, so that the plurality of waveguides are arranged substantially parallel. On the other hand, in the sound absorbing unit 110 described with reference to FIGS. 10 to 13, a plurality of partition walls divides the interior of the sound absorbing unit 110 into a plurality of waveguides, and each of which extends from a position inside the sound absorbing unit 110 toward the periphery of the sound absorbing unit 110 as viewed from the −D direction.

As shown in FIGS. 10A and 10B, the sound absorbing unit 110 has a perforated plate 120, which is a plate member having through-holes, and a chamber member 140 that is combined with the perforated plate 120 to form a cavity. The surface of the perforated plate 120 has a plurality of perforated regions each having a plurality of through-holes and a plurality of non-perforated regions having no through-holes. The sound absorbing unit 110 has a polygonal (specifically hexagonal) shape as viewed from the −D direction.

As shown in FIG. 12B, the chamber member 140 has spaces 141-146 separated from each other by partition walls 147-152. By providing the perforated plate 120 so as to cover the chamber member 140 from the −D direction side, the spaces 141 to 146 each become a waveguide having a wall formed by the chamber member 140 and the perforated plate 120. Specifically, space 141 is covered by perforated region 121 and non-perforated region 131 adjacent to perforated region 21. Space 142 is covered by perforated region 122 and non-perforated region 132. Space 143 is covered by perforated region 123 and non-perforated region 133. Space 144 is covered by perforated region 124 and non-perforated region 134. Space 145 is covered by perforated region 125 and non-perforated region 135. Space 146 is covered by perforated region 126 and non-perforated region 136.

The waveguides having spaces 141-146 are hereinafter referred to as waveguides 111-116, respectively. The partition walls 147-152 divide the interior of the sound absorbing unit 110 into a plurality of waveguides, and each waveguide is adjacent to the other two waveguides via the partition wall. Partition walls 147-152 extend from position 153 toward each vertex of the hexagon as viewed in the −D direction, and waveguides 111-116 each have a triangular shape as viewed in the −D direction. Since the position 153 is shifted from the center of the sound absorbing unit 110 as viewed from the −D direction, the waveguides 111, 116, and 115 have different shapes and sizes, and the waveguides 112, 113 and 114 have different shapes and sizes. Waveguide 112 and waveguide 113 have substantially the same cavity shape and size, but differ in the arrangement of through-holes formed in the respective walls. The waveguides 111 and 112, the waveguides 116 and 113, and the waveguides 114 and 115 have approximately the same cavity size, but differ in the arrangement of the through-holes formed on their respective walls.

The perforated surface of the perforated plate 120 forming the walls of the waveguides 111 to 116 is exposed as viewed from the −D direction. A sound wave arriving from the −D direction with respect to the sound absorbing unit 110 and incident on the perforated plate 120 enters the inside of each waveguide through a plurality of through-holes formed in the perforated region, travels in a direction non-parallel to the D direction in the area covered by the non-perforated region, and is reflected by the side surface of the chamber member 140. Each perforated region of the perforated plate 120 functions as an acoustic impedance matching member, and the waveguides 111 to 116 function as resonators having mutually different resonance characteristics. Therefore, according to the sound absorbing unit 110, a sound absorbing effect can be obtained in a wide frequency band compared to a sound absorber having a single waveguide.

For example, the waveguide 113 has a better sound absorption coefficient in a low frequency band than the waveguide 112, and the waveguide 114 has a better sound absorption coefficient in a lower frequency band than the waveguide 113. Also, the waveguide 116 has a better sound absorption coefficient in a low frequency band than the waveguide 111, and the waveguide 115 has a better sound absorption coefficient in a lower frequency band than the waveguide 116. The sound absorbing unit 110 may be designed so that the frequency bands of sound waves absorbed by the waveguides do not overlap each other, or the frequency bands of the sound waves absorbed by the waveguides may be partially overlapped. Unit 110 may be designed.

The length of non-perforated region 135 in the direction connecting the center of gravity of perforated region 125 and the center of gravity of non-perforated region 135 (length L5 in FIG. 10B) is longer than the waveguide 115 (thickness L6 in FIG. 11B) in the direction normal to the surface of the perforated plate 120. With such a configuration, in the waveguide 115, the length of the path along which the sound wave travels in a direction non-parallel to the D direction is increased, thereby improving the sound absorption coefficient in the low frequency band, while reducing the depth (i.e., thickness) of the sound absorbing unit 110 in the D direction.

Note that the arrangement of the through-holes in the sound absorbing unit 110 is not limited to the example shown in FIGS. 10A and 10B. FIG. 14 shows a modification of the perforated plate structure in the sound absorbing unit 110. A perforated region 221 and a perforated region 222 are newly provided in the perforated plate 220 of FIG. 14 as compared with the perforated plate 120 of FIGS. 10A and 10B. In other words, in the portion of the perforated plate 220 that constitutes the wall of the waveguide 115, the through-holes are arranged at a plurality of locations. Such a configuration can improve the sound absorption coefficient of the waveguide 111 in a high frequency band as compared with the case where the through-holes are arranged in one place (that is, the case where the perforated plate 120 is used). The distance between the perforated regions 125 and 221 on the surface of the perforated plate 220 (length L7 in FIG. 14) is longer than the length of the waveguide 111 in the direction normal to the surface of the perforated plate 220 (which equals to the thickness L6 in FIG. 11B). With such a configuration, in the waveguide 115, the length of the path along which the sound wave travels in a direction non-parallel to the D direction is increased, thereby improving the sound absorption coefficient in the low frequency band, while reducing the thickness of the sound absorbing unit 110.

(4-2) Modification 2 of Sound Absorbing Unit

Another modification of the configuration of the sound absorbing unit will be described. The sound absorbing unit 10 in the description of the above embodiment can be replaced with a sound absorbing unit of a modified example described below. FIGS. 15A and 15B are a perspective view and a front view, respectively, showing the structure of a sound absorbing unit according to a modification. FIGS. 16A and 16B are diagrams showing the structure of a chamber member according to a modification, respectively. In the sound absorbing unit 10 described with reference to FIGS. 1 to 4, the plurality of partition walls extend substantially in the same direction, so that the plurality of waveguides are arranged substantially parallel. On the other hand, in the sound absorbing unit 310 described with reference to FIGS. 15 and 16, a plurality of partition walls divide the interior of the sound absorbing unit 310 into a plurality of waveguides, and some of which extend in the H direction as viewed from the −D direction, and the remainder extends in the W direction. That is, a plurality of waveguides are arranged in the H direction and the W direction.

As shown in FIGS. 15A and 15B, the sound absorbing unit 310 includes a perforated plate 320, which is a plate member having through-holes, and a chamber member 340 that is combined with the perforated plate 320 to form a cavity. The surface of the perforated plate 320 has a perforated region 321 with a plurality of through-holes and non-perforated regions 331 and 332 without through-holes. The sound absorbing unit 110 has a polygonal (more specifically, quadrangular) shape as viewed from the −D direction.

As shown in FIGS. 16A and 16B, chamber member 340 has spaces 341-344 partitioned from each other by partition walls 345-347. By providing the perforated plate 320 so as to cover the chamber member 340 from the −D direction side, the spaces 341 to 344 become waveguides whose walls are formed by the chamber member 340 and the perforated plate 320, respectively. Specifically, the spaces 341 to 344 are each covered by a perforated region 321 and a non-perforated region 331 and a non-perforated region 332 adjacent to the perforated region 321 on opposite sides.

The waveguides having spaces 341-344 are hereinafter referred to as waveguides 311-314, respectively. The partition walls 345-347 divide the interior of the sound absorbing unit 310 into a plurality of waveguides, and each waveguide is adjacent to two or three other waveguides through the partition walls. The partition walls 345 to 347 extend in the H direction or W direction as viewed from the −D direction, and the waveguides 311 to 314 each have a rectangular shape as viewed from the −D direction. The waveguides 311-314 differ from each other in shape and size.

The perforated surface of the perforated plate 320 forming the walls of the waveguides 311 to 314 is exposed as viewed from the −D direction. A sound wave arriving from the −D direction with respect to the sound absorbing unit 310 and incident on the perforated plate 320 enters the inside of each waveguide through a plurality of through-holes formed in the perforated region, travels non-parallel to the D direction in the area covered by the non-perforated region, and is reflected by the side surface of the chamber member 340. The perforated region 321 of the perforated plate 320 functions as an acoustic impedance matching member, and the waveguides 311 to 314 function as resonators having mutually different resonance characteristics. Therefore, according to the sound absorbing unit 310, a sound absorbing effect can be obtained in a wide frequency band compared to a sound absorber having a single waveguide.

For example, the waveguide 311, the waveguide 314, the waveguide 313, and the waveguide 312 are superior in sound absorption coefficient in a low frequency band in that order. Conversely, the waveguide 312, the waveguide 313, the waveguide 314, and the waveguide 311 are superior in sound absorption coefficient in a high frequency band in that order. The sound absorbing unit 310 may be designed so that the frequency bands of sound waves absorbed by the waveguides do not overlap each other, or may be designed so that the frequency bands of the sound waves absorbed by the waveguides are partially overlapped.

It should be noted that the hole parameters in the through-hole region 321 may be uniform or may differ from portion to portion. For example, the hole parameters may be different for the portion in the perforated region 321 that is in contact with the space 341 (a portion overlapping the space 341 as viewed from the −D direction), the portion in the perforated region 321 that is in contact with the space 342, the portion in the perforated region 321 that is in contact with the space 343, and the portion in the perforated region 321 that is in contact with the space 344, respectively. Further, in the perforated region 321, there may be through holes that penetrate the perforated plate 320 and non-perforated holes that do not penetrate the perforated plate 320 (in other words, depressions existing on the −D direction side of the perforated plate 320). For example, the density of through holes may be different between a portion of the perforated region 321 contacting the space 341 and a portion of the perforated region 321 contacting the space 342, while keeping the same density of holes combined through holes and non-through holes uniform. According to such a configuration, the uniformity of the design can be maintained by unifying the apparent number of holes in the perforated plate 320, and the impedance can be matched with different hole parameters for each waveguide.

The total area of the non-perforated region 331 and the non-perforated region 332 of the surface of the perforated plate is larger than the area of the perforated region 321. This configuration allows the depth (i.e., thickness) of the sound absorbing unit 310 in the D direction to be reduced while improving the sound absorption coefficient in the low frequency band by increasing the length of the path where sound waves travel in a direction non-parallel to the D direction in each waveguide.

Although the shape of the perforated region 321 is a smooth rectangle in FIGS. 15A and 15B, the shape of the perforated region 321 is not limited to this, and may be other polygons or circles. Also, the perforated region 321 may be separated into a plurality of regions on the surface of the perforated plate 320.

(4-3) Modification 3 of Sound Absorbing Unit

Another modification of the configuration of the sound absorbing unit will be described. The sound absorbing unit 10 in the description of the above embodiment can be replaced with a sound absorbing unit of a modified example described below. FIGS. 17A and 17B are diagrams showing an overview of a sound absorbing unit according to a modification. FIGS. 18A and 18B are cross-sectional views of the HW section showing the structure of the sound absorbing unit according to the modification. In the sound absorbing unit 10 described with reference to FIGS. 1 to 4, the length (thickness) in the D direction differs from part to part. On the other hand, the sound absorbing unit 1010 described with reference to FIGS. 17 and 18 has a uniform length in the D direction.

As shown in FIGS. 17A and 17B, the sound absorbing unit 1010 is provided with a perforated plate 1020 having a surface substantially parallel to the HW plane. The perforated plate 1020 has a perforated region including a plurality of perforated regions 1021, 1022, 1023, and 1024, and a non-perforated region 1025 where no through-holes are formed. The surface of the perforated plate 1020 (the surface on which the through-holes are present) is substantially parallel to the HW plane. The perforated plate 1020 has a polygonal (more specifically, quadrangular) shape as viewed from the normal direction (D direction) of the perforated plate 1020. The perforated region of the perforated plate 1020 forms a triangular area connecting the center of the polygon, one vertex, and another point (specifically, one point on the side of the polygon) as viewed in the D direction.

As shown in FIGS. 18A and 18B, the sound absorbing unit 1010 has a waveguide 1011, a waveguide 1012, a waveguide 1013 and a waveguide 1014 having different lengths. The waveguides 1011 and 1012 are adjacent to each other across a sidewall 1012*b*, the waveguides 1012 and 1013 are adjacent to each other across a sidewall 1013*b*, and the waveguides 1013 and 1014 are adjacent to each other across a side wall 1014*b*. That is, the side wall 1012*b*, the side wall 1013*b*, and the side wall 1014*b* divide the interior of the sound absorbing unit 1010 into a plurality of waveguides.

Each of the waveguide 1011, waveguide 1012, waveguide 1013, and waveguide 1014 has a substantially trapezoidal (in other words, I-shaped) profile in the HW cross section. The waveguides 1011, 1012, 1013, and 1014 each extend in the width direction (W direction) of the sound absorbing unit 1010 and are arranged in parallel in the height direction (H direction) of the sound absorbing unit 1010. That is, the waveguides 1011, 1012, 1013 and 1014 each extend non-parallel to the normal direction (D direction) of the perforated plate 1020.

The sound absorbing unit 1010 has a shape with four-fold rotational symmetry as viewed in the D direction. That is, the sound absorbing unit 1010 has a total of four waveguides of the same shape for each of the waveguides 1011, 1012, 1013, and 1014. In addition, the sound absorbing unit 1010 has a total of four perforated regions of the same shape for each of the regions 1021, 1022, 1023, and 1024. A plurality of waveguides of the sound absorbing unit 1010 are arranged in directions (H direction and W direction) from the center of the perforated plate 1020 toward the periphery.

In addition, the sound absorbing unit 1010 may be configured as a whole, or may be configured by combining a plurality of members. For example, the sound absorbing unit 1010 may be configured by combining a plurality of resonators each having a waveguide and a perforated plate, or the sound absorbing unit 1010 may be configured by combining a perforated plate member and a waveguide member. Alternatively, the perforated plate and the waveguide may be integrally configured. That is, the sound absorbing unit 1010 only needs to have a perforated surface with perforated regions and non-perforated regions, and a plurality of waveguides each in contact with a different area within the perforated region. Ventilation between the inside and the outside of each waveguide is possible through a plurality of through-holes present in the through-hole region adjacent to one end in the extension direction of the waveguide.

Specifically, a portion near one end (the end in the +W direction) in the extension direction of the waveguide 1011 is in contact with the region 1021 and can be ventilated with the outside of the waveguide 1011 through a plurality of through-holes formed in the region 1021. A portion near the other end (−W direction end) in the extending direction of the waveguide 1011 is not in contact with the perforated region, but is in contact with the non-perforated region 1025 Therefore, the portion cannot be ventilated with the outside of the waveguide 1011. Similarly, the vicinity of one end (the end in the +W direction) of the waveguides 1012, 1013, and 1014 in the extending direction can be ventilated with the outside through a plurality of through-holes formed in is a region 1022, a region 1023, and a region 1024, respectively. And the other end of each waveguide is in contact with the non-perforated region 1025 and is not ventilable to the outside. The length of the portion of each waveguide that is in contact with the perforated region is half or less of the length in the extending direction of the waveguide. However, the ratio of the length of the portion of the waveguide that is in contact with the perforated region is not limited to this, and it does not matter if at least the portion near one end in the extending direction of the waveguide is in contact with the perforated region.

With such a structure, sound waves coming from the −D direction with respect to the sound absorbing unit 1010 and incident on the perforated plate 1020 pass through the plurality of through-holes formed in the perforated region and near one end of each waveguide, travels in the extension direction of each waveguide, and is reflected at the other end. Each perforated region of the perforated plate 1020 functions as an acoustic impedance matching member, and the waveguides 1011, 1012, 1013, and 1014 function as resonators having mutually different resonance characteristics. Therefore, according to the sound absorbing unit 1010, a sound absorbing effect can be obtained in a wide frequency band compared to a sound absorber having a single waveguide. The sound absorption characteristics of the sound absorbing unit 1010 in this embodiment are represented, for example, by the sound absorption coefficient or acoustic impedance for each frequency. The sound absorbing unit 1010 may be designed so that the frequency bands of sound waves absorbed by the waveguides do not overlap each other, or the frequency bands of the sound waves absorbed by the waveguides are partially overlapped.

In the extending direction (W direction), the length of waveguide 1011 is longer than the length of waveguide 1012, the length of waveguide 1012 is longer than the length of waveguide 1013, and the length of waveguide 1013 is longer than the length of waveguide 1014. By making the lengths of the waveguides different in this way, the resonance characteristics of the waveguides can be made different. Each waveguide extends in the H direction or the W direction, and the depth of the waveguide in the D direction is shorter than the length in the extension direction of the waveguide. With such a configuration, it is possible to reduce the depth (thickness) of the sound absorbing unit 1010 in the D direction while improving the sound absorption coefficient in the low frequency band by increasing the length of the waveguide in the extending direction can.

(4-4) Modification 4 of Sound Absorbing Unit

Another modification of the configuration of the sound absorbing unit will be described. The sound absorbing unit 10 in the description of the above embodiment can be replaced with a sound absorbing unit of a modified example described below. FIG. 19A is a perspective view showing an overview of a modification of the sound absorbing unit. FIGS. 20A and 20B are cross-sectional views showing the structure of a modification of the sound absorbing unit. While the sound absorbing unit 1010 described with reference to FIGS. 17 and 18 has a four-fold rotational symmetry, the perforated plate 1120 and internal structure of the sound absorbing unit 1110 shown in FIGS. 19 and 20 are not point symmetrical.

As shown in FIGS. 19A and 19B, the sound absorbing unit 1110 is provided with a perforated plate 1120 having a surface substantially parallel to the HW plane. Perforated plate 1120 includes a perforated region including regions 1121, 1122, 1123 and 1124 with multiple through-holes, a perforated region including regions 1126, 1127, 1128 and 1129 with multiple through-holes, and non-perforated region 1125 where no through-holes are formed. The hole parameters for through-holes in the perforated region including areas 1121-1124 may be different than the hole parameters for through-holes in the perforated region including areas 1126-1129.

As shown in FIGS. 20A and 20B, the sound absorbing unit 1110 has a waveguide 1111, a waveguide 1112, a waveguide 1113 and a waveguide 1114 having different lengths. Also, the sound absorbing unit 1110 has a waveguide 1115, a waveguide 1116, a waveguide 1117 and a waveguide 1118 having different lengths. The waveguides 1111 to 1114 and the waveguides 1115 to 1118 are mutually different in at least one of length and shape.

Each of the waveguide 1111, waveguide 1112, waveguide 1113, and waveguide 1114 has a substantially trapezoidal (in other words, I-shaped) profile in the HW cross section. The waveguides 1111 to 1114 extend in the W direction or the H direction and are arranged in the direction from the center of the perforated plate 1120 toward the periphery. Each of the waveguide 1115, waveguide 1116, waveguide 1117, and waveguide 1118 has a shape in which the contour in the HW cross section is bent twice (in other words, a U shape). The waveguides 1115 to 1118 have a portion extending in the W direction and a portion extending in the H direction, and are arranged in a direction from the center of the perforated plate 1120 toward the periphery.

The portions near one end of the waveguides 1111, 1112, 1113, and 1114 in the extending direction can be vented to the outside through a plurality of through-holes formed in regions 1121, 1122, 1123, and 1124, respectively. In addition, the portions near one end of the waveguides 1115, 1116, 1117, and 1118 in the extending direction can be vented to the outside through a plurality of through-holes formed in regions 1126, 1127, 1128, and 1129, respectively. And the portion near the other end of each waveguide is in contact with the non-perforated region 1125 and is not ventilable to the outside.

Since some of the waveguides included in the sound absorbing unit 1110 have a bent shape, the length in the extending direction of those waveguides can be made longer than the dimension in the W direction and the dimension in the H direction of the sound absorbing unit 1110. With such a configuration, it is possible to reduce the size of the sound absorbing unit 1110 while improving the sound absorption coefficient in the low frequency band by increasing the length of the waveguide in the extending direction. In addition, since the sound absorbing unit 1110 has a non-rotationally symmetrical shape, there are many patterns of lengths and shapes of the waveguides included in the sound absorbing unit 1110. Waveguides of different lengths and shapes have different sound absorption properties. Therefore, according to the sound absorbing unit 1110, compared with the sound absorbing unit 1010 having a rotationally symmetrical shape, a sound absorbing effect can be obtained in a wide frequency band. On the other hand, according to the sound absorbing unit 1010, since it has a plurality of waveguides having the same sound absorbing characteristics, it is possible to obtain a higher sound absorbing effect in a specific frequency band than the sound absorbing unit 1110 does.

The sound absorbing unit 1010 shown in FIGS. 17 and 18 has a total of 16 waveguides, and the sound absorbing unit 1110 shown in FIGS. 19 and 20 has a total of 8 waveguides. The number of waveguides and the partitioning method inside the sound absorbing unit are not limited to these examples. The number and arrangement of perforated regions in the perforated plate of the sound absorbing unit differ according to the number of waveguides that the sound absorbing unit has and how the inside of the sound absorbing unit is partitioned.

(4-5) Modification 5 of Sound Absorbing Unit

Another modification of the sound absorbing unit will be described. The sound absorbing unit 10 in the description of the above embodiment can be replaced with a sound absorbing unit of a modified example described below. FIG. 21A is a perspective view showing an overview of a modification of the sound absorbing unit. FIGS. 22A and 22B are cross-sectional views showing the structure of a modification of the sound absorbing unit. The interior of the sound absorbing unit 1010 described with reference to FIGS. 17 and 18 is partitioned by side walls extending from the center of the sound absorbing unit 1010 toward each vertex in the HW cross section. On the other hand, the interior of the sound absorbing unit 1310 shown in FIGS. 21 and 22 is partitioned by side walls extending from the center of the sound absorbing unit 1310 toward each side in the HW cross section. The sound absorbing unit 1310 has a shape with four-fold rotational symmetry as viewed in the D direction.

A perforated plate 1320 provided in the sound absorbing unit 1310 has a perforated region in which a plurality of through-holes are formed and a non-perforated region in which no through-holes are formed. The sound absorbing unit 1310 has four waveguides each having four shapes with different lengths. Each of the waveguides included in the sound absorbing unit 1310 has a shape in which the outline in the HW cross section is bent once (in other words, an L shape). Each waveguide has a portion extending in the W direction and a portion extending in the H direction, and are aligned in a direction from the center to the periphery of the perforated plate 1320. A portion near one end in the extending direction of the waveguide of the sound absorbing unit 1310 can be ventilated with the outside through a plurality of through-holes formed in the perforated region of the perforated plate 1320. A portion in the vicinity of the other end in the extending direction of the waveguide is in contact with the non-perforated region and is not ventilable to the outside.

According to the sound absorbing unit 1310, since it has a plurality of types of waveguides with mutually different lengths, it is possible to obtain a sound absorbing effect in a wide frequency band. Furthermore, according to the sound absorbing unit 1310, since it has a plurality of waveguides with approximately the same length, it is possible to obtain a high sound absorbing effect in a specific frequency band. The sound absorbing unit 1310 shown in FIGS. 21 and 22 has a shape with four-fold rotational symmetry, but a sound absorbing unit may be configured by applying the structure described with reference to FIGS. 19 and 20 to the sound absorbing unit 1310. Thereby, a sound absorbing effect can be obtained in a wider frequency band.

(4-6) Modification 6 of Sound Absorbing Unit

Another modification of the sound absorbing unit will be described. The sound absorbing unit 10 in the description of the above embodiment can be replaced with a sound absorbing unit of a modified example described below. FIG. 23A is a perspective view showing an overview of a modification of the sound absorbing unit. FIGS. 24A and 24B are cross-sectional views showing the structure of a modification of the sound absorbing unit. While the sound absorbing unit 1010 described with reference to FIGS. 17 and 18 has a four-fold rotational symmetry, the perforated plate 1420 and internal structure of the sound absorbing unit 1410 shown in FIGS. 23 and 24 are not point symmetrical. The external shape of the sound absorbing unit 1410 is a rhombus as viewed from the D direction.

As shown in FIGS. 23A and 23B, the sound absorbing unit 1410 is provided with a perforated plate 1420 having a surface substantially parallel to the HW plane. The perforated plate 1420 has a perforated region 1421 in which a plurality of through-holes are formed and a non-perforated region 1425 in which no through-holes are formed. The perforated plate 1420 has a rectangular shape as viewed from the normal direction (D direction) of the perforated plate 1420. The perforated region of the perforated plate 1420 forms a triangular area connecting the three vertices of the quadrangle as viewed from the D direction.

As shown in FIGS. 24A and 24B, the sound absorbing unit 1410 has multiple waveguides of different lengths. Each of the waveguides included in the sound absorbing unit 1410 has a shape in which the contour in the HW cross section is bent once (in other words, an L shape). The multiple waveguides of the sound absorbing unit 1410 extend in a direction non-parallel to the D direction and are arranged in a direction non-parallel to the D direction. A portion near one end in the extending direction of each waveguide of the sound absorbing unit 1410 can be ventilated with the outside through a plurality of through-holes formed in the through-hole region 1421. The portion near the other end of each waveguide is in contact with the non-perforated region 1425 and is not ventilable to the outside.

A waveguide included in the sound absorbing unit 1410 extends in a direction substantially perpendicular to the D direction and has a bent shape. Therefore, the length of at least one of the plurality of waveguides included in the sound absorbing unit 1410 in the extending direction is made longer than any of the W, H, and D dimensions of the sound absorbing unit 1410. be able to. With such a configuration, it is possible to reduce the size of the sound absorbing unit 1410 while improving the sound absorption coefficient in the low frequency band by increasing the length of the waveguide in the extending direction. Moreover, according to the sound absorbing unit 1410, it is possible to increase the difference in the length of the plurality of waveguides in the extending direction while arranging the plurality of waveguides in parallel. As a result, a well-balanced sound absorption effect can be obtained in a wide frequency band from low frequency bands to high frequency bands.

(4-7) Modification 7 of Sound Absorbing Unit

Another modification of the sound absorbing unit will be described. The sound absorbing unit 10 in the description of the above embodiment can be replaced with a sound absorbing unit of a modified example described below. FIG. 25A is a perspective view showing an overview of a modification of the sound absorbing unit. FIGS. 26A and 26B are cross-sectional views showing the structure of a modification of the sound absorbing unit. The outer shape of the sound absorbing unit 1010 described with reference to FIGS. 17 and 18 is a quadrangle as viewed from the D direction. On the other hand, the outer shape of the sound absorbing unit 1510 shown in FIGS. 25 and 26 is substantially circular as viewed from the D direction. The sound absorbing unit 1510 has a shape with four-fold rotational symmetry as viewed in the D direction.

A perforated plate 1520 provided in the sound absorbing unit 1510 has a perforated region 1521 having a plurality of through-holes and a non-perforated region 1525 having no through-holes. The perforated plate 1520 has a circular shape as viewed from the normal direction (D direction) of the perforated plate 1520. The perforated region of the perforated plate 1520 forms a fan-shaped area connecting the center of the circle and two points on the circumference as viewed from the D direction.

The sound absorbing unit 1510 has four waveguides each having four shapes with different lengths. Each of the waveguides included in the sound absorbing unit 1510 has an arc-shaped contour in the HW cross section. Each waveguide extends in the circumferential direction of the sound absorbing unit 1510 as viewed from direction D, and is arranged concentrically in the direction from the center of the perforated plate 1520 toward the periphery. A portion near one end in the extending direction of the waveguide of the sound absorbing unit 1510 can ventilate with the outside through a plurality of through-holes formed in the perforated region 1521 of the perforated plate 1520. A portion near the other end in the extending direction of the waveguide is in contact with the non-perforated region 1525 and is not ventilable to the outside.

Since the sound absorbing unit 1510 has a plurality of types of waveguides with different lengths, it is possible to obtain a sound absorbing effect in a wide frequency band. Furthermore, according to the sound absorbing unit 1510, since it has a plurality of waveguides with approximately the same length, it is possible to obtain a high sound absorbing effect in a specific frequency band. Although the sound absorbing unit 1510 shown in FIGS. 25 and 26 has a shape with four-fold rotational symmetry, by applying the structure described using FIGS. 19 and 20 to the sound absorbing unit 1510, a sound absorbing unit with a shape that is not rotationally symmetrical may be constructed. Thereby, a sound absorbing effect can be obtained in a wider frequency band.

(4-8) Modification 8 of Sound Absorbing Unit

Another modification of the sound absorbing unit will be described. The sound absorbing unit 10 in the description of the above embodiment can be replaced with a sound absorbing unit of a modified example described below. FIGS. 27A and 27B are diagrams showing an overview and structure of a modification of the sound absorbing unit. FIGS. 28 and 29 are diagrams showing structures of modifications of the sound absorbing unit. In the sound absorbing unit 1010 described with reference to FIGS. 17 and 18, each waveguide extends substantially linearly, whereas the sound absorbing unit 1610 shown in FIGS. 27 through 30 includes a plurality of waveguides with different numbers of bends.

As shown in FIG. 27A, the sound absorbing unit 1610 is provided with a perforated plate 1620 having a surface substantially parallel to the HW plane. The perforated plate 1620 has a plurality of perforated regions 1621 each having a plurality of through-holes and a non-perforated region 1625 having no through-holes. The hole parameters of through-holes in multiple through-hole regions 1621 may be different from each other.

FIG. 27B shows a front view of the sound absorbing unit 1610 through the perforated plate 1620 so that the internal structure of the sound absorbing unit 1610 (especially the shape of the waveguide) can be easily understood. FIG. 28 shows the inside of the sound absorbing unit 1610 and the perforated plate 1620 seen through from the rear surface of the sound absorbing unit 1610. As shown in FIG. 27B, the sound absorbing unit 1610 includes a plurality of waveguides 1611, 1612, 1613, 1614, 1615, 1616, 1617, and 1618 having different lengths. Further, the sound absorbing unit 1610 has a shape with four-fold rotational symmetry, and has three other waveguides of the same shape for each of the waveguides 1611 through 1618.

Each of the waveguides 1611 to 1614 has a linear contour (in other words, an I shape) in the HW cross section. Each of the waveguides 1615 to 1618 has a portion extending in the W direction and a portion extending in the H direction, and the profile in the HW cross section is bent twice (in other words, a U shape). The portions near one end in the extending direction of waveguides 1611 to 1618 can be vented to the outside via a plurality of through-holes formed in through-hole region 1621, respectively. And the portion near the other end of each waveguide is in contact with the non-perforated region 1625 and is not ventilable to the outside.

Since some of the waveguides included in the sound absorbing unit 1610 have a bent shape, the length in the extending direction of these waveguides can be longer than the dimension in the W direction and the dimension in the H direction of the sound absorbing unit 1610. With such a configuration, it is possible to reduce the size (especially the thickness in the D direction) of the sound absorbing unit 1610 while improving the sound absorption coefficient in the low frequency band by increasing the length of the waveguide in the extending direction. The sound absorbing unit 1610 also has a short waveguide that is not bent. This increases the pattern of lengths and shapes of waveguides included in the sound absorbing unit 1610. Waveguides of different lengths and shapes have different sound absorption properties. Therefore, according to the sound absorbing unit 1610, compared to the sound absorbing unit 1010 in which each waveguide has the same number of bends, a sound absorbing effect can be obtained in a wide frequency band.

FIG. 29A is a side view of the sound absorbing unit 1610 viewed from direction H, and FIG. 29B is a transparent side view of the sound absorbing unit 1610 so that the internal structure of the sound absorbing unit 1610 can be easily understood. As shown in FIGS. 29A and 29B, a recessed notch 1630 is provided on the outer shape of the side surface of the sound absorbing unit 1610. Since the sound absorbing unit 1610 has the notch 1630, a sound absorbing wall using the sound absorbing unit 1610 can be easily created.

FIGS. 30A and 30B are diagrams showing the structure of a sound absorbing wall using the sound absorbing unit 1610. As shown in FIG. 30A, a sound absorbing wall 1600 is created by fitting sound absorbing units 1610 into each of a plurality of spaces 1602 surrounded by frames 1601. Specifically, as shown in FIG. 30B, the sound absorbing unit 1610 is fixed to the frame 1601 by fitting the notch 1630 of the sound absorbing unit 1610 with the projection of the frame 1601. In the sound absorbing wall 1600, the plurality of sound absorbing units 1610 are arranged such that the normal directions of the plurality of perforated plates 1620 of the plurality of sound absorbing units 1610 are substantially parallel to each other. Note that the sound absorbing unit 1610 may be fitted in only part of the plurality of spaces 1602 that the frame 1601 has. Moreover, the plurality of sound absorbing units included in the sound absorbing wall 1600 may have different structures. For example, the sound absorbing wall 1600 may be configured by providing the sound absorbing unit of each of the above-described embodiments and modifications with the notch 1630 and combining a plurality of types of sound absorbing units with the frame 1601.

(4-6) Modification 9 of Sound Absorbing Unit

Another modification of the sound absorbing unit will be described. The sound absorbing unit 10 in the description of the above embodiment can be replaced with a sound absorbing unit of a modified example described below. FIG. 31A is a perspective view showing an overview of a modification of the sound absorbing unit. FIG. 31B is a front view showing an overview of a modification of the sound absorbing unit. FIG. 32A is a semi-transparent perspective view to facilitate understanding of the structure of the modification of the sound absorbing unit. FIG. 32B is a front view to facilitate understanding of the structure of the modification of the sound absorbing unit. While the sound absorbing unit 1010 described with reference to FIGS. 17 and 18 has a four-fold rotational symmetry, the perforated plate 1720 and internal structure of the sound absorbing unit 1710 shown in FIGS. 31 and 32 are not point symmetrical. Also, the sound absorbing unit 1710 includes a plurality of waveguides with different numbers of bends.

As shown in FIGS. 31A and 31B, the sound absorbing unit 1710 is provided with a perforated plate 1720 having a surface substantially parallel to the HW plane. The perforated plate 1720 has a plurality of perforated regions 1721 each having a plurality of through-holes and a non-perforated region 1725 having no through-holes. The hole parameters of through-holes in multiple through-hole regions 1721 may be different from each other.

As shown in FIGS. 32A and 32B, the sound absorbing unit 1710 has multiple waveguides of different lengths. Each of waveguide 1716, waveguide 1717, waveguide 1718, and waveguide 1719 has a linear (in other words, I-shaped) contour in the HW cross section. Each of the waveguides 1711, 1714, and 1701 has a portion extending in the W direction and a portion extending in the H direction, and the profile in the HW cross section is bent once (in other words, and L-shaped). Each of the waveguides 1712, 1713, and 1715 has a portion extending in the W direction and a portion extending in the H direction, and the profile in the HW cross section is bent twice (in other words, and U-shaped). A portion near one end in the extending direction of each waveguide can ventilate with the outside through a plurality of through-holes formed in the through-hole region 1721. And the portion near the other end of each waveguide is in contact with the non-perforated region 1725 and is not ventilable to the outside.

Some waveguides included in the sound absorbing unit 1710 extend in a direction substantially perpendicular to the D direction and have a bent shape. Therefore, the length of at least one of the plurality of waveguides included in the sound absorbing unit 1710 in the extending direction can be longer than any of the W, H, and D dimensions of the sound absorbing unit 1710. With such a configuration, it is possible to reduce the size (especially the thickness in the D direction) of the sound absorbing unit 1710 while improving the sound absorption coefficient in the low frequency band by increasing the length of the waveguide in the extending direction. Also, the sound absorbing unit 1710 has a waveguide that is not bent, a waveguide that is bent once, and a waveguide that is bent twice. This increases the pattern of lengths and shapes of waveguides included in the sound absorbing unit 1710. Waveguides of different lengths and shapes have different sound absorption properties. Therefore, according to the sound absorbing unit 1710, compared with the sound absorbing unit 1010 in which each waveguide has the same number of bends, it is possible to obtain a sound absorbing effect in a wide frequency band.

(5) Other Modifications

In the above-described embodiments, the sound absorbing unit has a combination of multiple waveguides with different shapes and sizes and a combination of multiple waveguides with substantially the same shape and size. However, the present embodiment is not limited to this, and the sound absorbing unit only needs to have a cavity surrounded by an outer shell and a through-hole that communicates the inside and the outside of the cavity. That is, the sound absorbing unit only needs to have at least one space in which air resonates, and it is not essential that the sound absorbing unit has a partition wall that divides the internal space. Moreover, the number of cavities and the number of through-holes that the sound absorbing unit has may be one or more. However, if the sound absorbing unit has a plurality of cavities (waveguides) that are mutually different in at least one of shape and size, sound in a wider frequency band can be absorbed. In addition, by forming a plurality of through-holes in one hollow portion, it is possible to reduce the bias of the sound absorption coefficient according to the frequency (that is, smooth the peak of the sound absorption characteristics). Further, in the above-described embodiment, the plurality of waveguides of the sound absorbing unit have different through-hole arrangements, but the present embodiment is not limited to this, and the sound absorbing unit may include a plurality of waveguides having the same through-hole arrangement. By providing the sound absorbing unit with two or more waveguides having mutually different resonance characteristics, sound in a wide frequency band can be absorbed. On the other hand, if some of the plurality of waveguides of the sound absorbing unit have resonance characteristics close to each other, the sound absorption coefficient in a specific frequency band can be improved.

In the above-described embodiments, the length of the waveguide in the direction normal to the surface of the perforated plate is assumed to be non-uniform. For example, the thickness of the sound absorbing unit 10 in the D direction is thicker at the central portion seen from the −D direction than at the peripheral edge seen from the −D direction. According to such a configuration, the volume of each waveguide can be increased compared to the case where the thickness of the sound absorbing unit 10 is made equal to the thickness of the peripheral portion as viewed from the −D direction, thereby sound absorption performance in the frequency band can be improved. However, the thickness in the D direction of the sound absorbing unit 10 is not limited to this, and may be uniform. In this case, the length of the waveguide in the direction normal to the surface of the perforated plate is also uniform.

In the sound absorbing unit according to the above-described embodiment, the cavity portion (waveguide) is formed by the perforated plate and the base body (chamber member) integrally fixed to the perforated plate. Note that the perforated plate provided in the sound absorbing unit may be configured to be detachable from the chamber member. That is, the sound absorbing unit may be composed of a three-dimensional member having a plurality of waveguides and a perforated plate that can be attached to the three-dimensional member. As a result, even when the perforated plate is worn out and the sound absorption characteristics of the sound absorbing unit deteriorate, the perforated plate can be easily replaced to improve the sound absorption characteristics of the sound absorbing unit. Further, by replacing the perforated plate with another perforated plate having different hole parameters, the sound absorption characteristics of the sound absorbing unit can be arbitrarily adjusted. When the perforated plate and the chamber member are separable, the partition wall that divides the internal space of the sound absorbing unit may be provided in the chamber member or the perforated plate, or independent of both the chamber member and the chamber member.

At least one of the perforated plate and the partition provided in the sound absorbing unit may be configured to be movable. Also, a new member may be added inside the waveguide. This makes it easy to adjust the shape and size of the waveguide, and allows the sound absorption characteristics of the sound absorbing unit to be adjusted arbitrarily. Note that the number of waveguides included in the sound absorbing unit is not limited to the above example, and the sound absorbing unit may have a plurality of waveguides that differ in at least one of shape and length.

In the above-described embodiments and modifications, the sound absorbing unit has a hexagonal shape as viewed from the −D direction, a perforated surface is provided on the surface of the sound absorbing unit on the −D direction side, and the interior of the sound absorbing unit is divided into multiple cavities by partition walls. However, the shape of the sound absorbing unit may be other polyhedrons or spheres. Also, the perforated surface may be provided on another surface of the sound absorbing unit. Moreover, the perforated surface may be provided only on a part of one surface of the sound absorbing unit, or may be provided on a plurality of surfaces of the sound absorbing unit. Also, the inside of the sound absorbing unit may contain a structure other than the cavity.

As described with reference to FIGS. 6 and 7, by arranging a plurality of sound absorbing units side by side, sound can be absorbed over a wide range. At this time, a plurality of sound absorbing units having the same shape may be arranged side by side, or a plurality of sound absorbing units having different shapes may be arranged side by side. For example, multiple types of sound absorbing units described in the above-described embodiment and modifications may be arranged side by side. Further, for example, a plurality of sound absorbing units having the same waveguide shape but different hole parameters of the perforated plate may be arranged side by side. By arranging a plurality of sound absorbing units having different sound absorbing characteristics side by side, a sound absorbing effect can be obtained in a wider frequency band than when the same sound absorbing units are arranged side by side. On the other hand, when the same sound absorbing units are arranged side by side, a higher sound absorbing effect can be obtained in a specific frequency band than when a plurality of sound absorbing units having different sound absorption characteristics are arranged side by side.

According to the above disclosure, high sound absorbing performance over a wide band while suppressing the thickness of the sound absorber can be realized.

Although the embodiments of the present invention are described in detail above, the scope of the present invention is not limited to the above embodiments. Further, various modifications and changes can be made to the above embodiments without departing from the spirit of the present invention. Also, the above embodiments and modifications may be combined.

REFERENCE SIGNS LIST

1: Sound absorbing wall
10: sound absorbing unit
20: perforated plate

What is claimed is:

1. A sound absorber comprising a plurality of cavities mutually different in at least one of shape and size, wherein a wall of a first cavity included in the plurality of cavities includes a first region and a second region, wherein a plurality of through-holes connecting an interior of the first cavity to an exterior of the first cavity is formed in the first region, and wherein no through-holes connecting the interior of the first cavity and the exterior of the first cavity is formed in the second region adjacent to the first region, a wall of a second cavity included in the plurality of cavities includes a third region and a fourth region, wherein a plurality of through-holes connecting an interior of the second cavity to an exterior of the second cavity is formed in the third region, and wherein no through-holes connecting the interior of the second cavity and the exterior of the second cavity is formed in the fourth region adjacent to the third region, and size of through-holes in the first region is different from size of through-holes in the third region.

2. A sound absorber comprising a plurality of cavities different in at least one of shape and size, wherein a wall of a first cavity included in the plurality of cavities includes a first region and a second region, wherein a plurality of through-holes connecting an interior of the first cavity to an exterior of the first cavity is formed in the first region, and wherein no through-holes connecting the interior of the first cavity and the exterior of the first cavity is formed in the second region adjacent to the first region, a wall of a second cavity included in the plurality of cavities includes a third region and a fourth region, wherein a plurality of through-holes connecting an interior of the second cavity to an exterior of the second cavity is formed in the third region, and wherein no through-holes connecting the interior of the second cavity and the exterior of the second cavity is formed in the fourth region adjacent to the third region, and density of through-holes in the first region is different from density of through-holes in the third region.

3. The sound absorber according to claim 2, wherein through-holes are formed in a designed arrangement in a plate member constituting a wall of a cavity included in the plurality of cavities.

4. The sound absorber according to claim 2, wherein the plurality of cavities function as resonators having mutually different resonance characteristics.

5. The sound absorber according to claim 2, wherein a surface with through-holes in a plate member that constitutes a wall of each of the plurality of cavities is exposed as viewed from a predetermined direction.

6. The sound absorber according to claim 2, wherein the plurality of cavities are adjacent to each other across a partition wall.

7. The sound absorber according to claim 2, wherein length of the second region in a predetermined direction along a surface of a plate member constituting the wall with through-holes of the first cavity is longer than length of the first cavity in a direction normal to the surface of the plate member.

8. The sound absorber according to claim 2, wherein the wall of the first cavity further includes a fifth region that is not adjacent to the first region and is adjacent to the second region, wherein a plurality of through-holes connecting the interior of the first cavity and the exterior of the first cavity is formed in the fifth region.

9. The sound absorber according to claim 8, wherein a distance between the first region and the fifth region in a predetermined direction along a surface of a plate member constituting the wall with through-holes of the first cavity is longer than length of the cavity in a direction normal to the surface of the plate member.

10. The sound absorber according to claim 2, wherein length of the first cavity in a direction normal to a surface of a plate member constituting the wall with through-holes of the first cavity is non-uniform.

11. The sound absorber according to claim 2, wherein a portion near one end in an extending direction of the first cavity is in contact with the first region, and a portion near other end in the extending direction of the first cavity is in contact with the second region.

12. The sound absorber according to claim 2, wherein the first cavity extends in a direction substantially perpendicular to a direction normal to a surface of a plate member constituting the wall with through-holes of the first cavity.

13. The sound absorber according to claim 2, wherein length of the first cavity in a direction normal to a surface of a plate member constituting the wall with through-holes of the first cavity is shorter than length in an extending direction of the first cavity.

14. A sound absorbing panel comprising:

the sound absorber according to claim 2; and a mounting configured to mount the sound absorber on a wall surface.

15. A sound absorbing wall comprising a plurality of sound absorbers according to claim 2, wherein a surface with through-holes of each of the plurality of sound absorbers is exposed as viewed from a predetermined direction.

16. The sound absorber according to claim 2, wherein the plurality of through-holes formed in the first region is arranged at substantially equal intervals, and the plurality of through-holes formed in the third region is arranged at substantially equal intervals.

17. The sound absorber according to claim 2, wherein a plate member constituting a wall of a cavity included in the plurality of cavities has a curved or uneven surface.

18. A sound absorber comprising a plurality of cavities mutually different in at least one of shape and size, wherein a wall of a first cavity included in the plurality of cavities includes a first region and a second region, wherein a plurality of through-holes connecting an interior of the first cavity to an exterior of the first cavity is formed in the first region, and wherein no through-holes connecting the interior of the first cavity and the exterior of the first cavity is formed in the second region adjacent to the first region, a wall of a second cavity included in the plurality of cavities includes a third region and a fourth region, wherein a plurality of through-holes connecting an interior of the second cavity to an exterior of the second cavity is formed in the third region, and wherein no through-holes connecting the interior of the second cavity and the exterior of the second cavity is formed in the fourth region adjacent to the third region, and a number of through-holes in the first region is different from a number of through-holes in the third region.

* * * * *